US012765670B2

(12) United States Patent
Chen et al.

(10) Patent No.: US 12,765,670 B2
(45) Date of Patent: Oct. 20, 2026

(54) SLIDE RAIL ASSEMBLY

(71) Applicants: KING SLIDE WORKS CO., LTD., Kaohsiung City (TW); KING SLIDE TECHNOLOGY CO., LTD., Kaohsiung City (TW)

(72) Inventors: Ken-Ching Chen, Kaohsiung City (TW); Shun-Ho Yang, Kaohsiung City (TW); Wei-Chen Chang, Kaohsiung City (TW); Chun-Chiang Wang, Kaohsiung City (TW)

(73) Assignees: KING SLIDE WORKS CO., LTD., Kaohsiung City (TW); KING SLIDE TECHNOLOGY CO., LTD., Kaohsiung City (TW)

( * ) Notice: Subject to any disclaimer, the term of this patent is extended or adjusted under 35 U.S.C. 154(b) by 38 days.

(21) Appl. No.: 19/052,298

(22) Filed: Feb. 13, 2025

(65) Prior Publication Data

US 2026/0117820 A1 Apr. 30, 2026

(30) Foreign Application Priority Data

Oct. 30, 2024 (TW) ..... 113142033

(51) Int. Cl.
*A47B 88/57* (2017.01)
*A47B 88/443* (2017.01)

(52) U.S. Cl.
CPC ..... *A47B 88/57* (2017.01); *A47B 88/443* (2017.01); *A47B 2210/0016* (2013.01); *A47B 2210/0018* (2013.01)

(58) Field of Classification Search
CPC ..... A47B 88/443; A47B 88/53; A47B 88/57; A47B 88/16; A47B 2210/0016; A47B 2210/0018; A47B 2210/0089
See application file for complete search history.

(56) References Cited

U.S. PATENT DOCUMENTS 6,935,710 B2 8/2005 Chen
10,743,660 B2 8/2020 Chen
(Continued)

FOREIGN PATENT DOCUMENTS

CN 108720377 A * 11/2018
EP 4 002 967 A1 5/2022
(Continued)

*Primary Examiner* — Andrew Roersma
(74) *Attorney, Agent, or Firm* — Winston Hsu

(57) ABSTRACT

A slide rail assembly is provided and includes a first rail having a predetermined feature, a second rail, a resilient member arranged on the second rail, and an operating member movable relative to the second rail. The operating member at a first operating position is configured to abut against the resilient member to prevent the resilient member from being blocked by the predetermined feature, thereby allowing the resilient member to pass over the predetermined feature as the second rail is displaced relative to the first rail along a first direction. The operating member at a second operating position is configured not to abut against the resilient member to allow the resilient member to be blocked by the predetermined feature, thereby stopping the second rail at a working position when the second rail is displaced and reaches the working position relative to the first rail along the first direction.

16 Claims, 18 Drawing Sheets

(56) References Cited

U.S. PATENT DOCUMENTS

| | | | | |
|---|---|---|---|---|
| 2002/0021061 | A1 | 2/2002 | Lammens | |
| 2013/0058596 | A1 | 3/2013 | Chen | |
| 2016/0262538 | A1* | 9/2016 | Chen | A47B 88/44 |
| 2018/0295989 | A1* | 10/2018 | Chen | F16C 29/12 |
| 2018/0295990 | A1* | 10/2018 | Chen | A47B 88/49 |
| 2021/0120951 | A1* | 4/2021 | Chen | A47B 88/57 |
| 2021/0145173 | A1* | 5/2021 | Chen | A47B 88/443 |
| 2021/0145174 | A1* | 5/2021 | Chen | A47B 88/443 |
| 2025/0151900 | A1* | 5/2025 | Chen | A47B 88/473 |
| 2025/0176714 | A1* | 6/2025 | Chen | A47B 88/477 |
| 2025/0176716 | A1* | 6/2025 | Chen | A47B 88/483 |

FOREIGN PATENT DOCUMENTS

| | | | |
|---|---|---|---|
| JP | 2017-47166 | A | 3/2017 |
| JP | 2024-31748 | A | 3/2024 |
| TW | 201544048 | A | 12/2015 |
| TW | 202231221 | A | 8/2022 |

* cited by examiner

SLIDE RAIL ASSEMBLY

BACKGROUND OF THE INVENTION

1. Field of the Invention

The present invention relates to a slide rail product, and more specifically, to a slide rail assembly having a first rail, a second rail and an operating member configured to enable or disable a blocking function that stops the second rail at a working position relative to the first rail when the second rail is displaced and reaches a working position relative to the first rail.

2. Description of the Prior Art

Generally, a slide rail assembly is a device adapted for a rack or a cabinet and configured to support a carried object, such as an electronic apparatus or a drawer. The slide rail assembly usually includes an outer rail and an inner rail displaceable relative to the outer rail between a retracted position and an extended position. Preferably, the slide rail assembly can further include a middle rail movably mounted between the outer rail and the inner rail for extending a travel distance of the inner rail relative to the outer rail.

With development of the slide rail industry, it is becoming prevalent to use a blocking mechanism or a positioning mechanism for preventing a relative displacement of two slide rails, such as a relative displacement of the inner rail and the middle rail or a relative displacement of the middle rail and the outer rail, when one of the two slide rails is located at a predetermined position relative to the other one of the two slide rails.

For example, in U.S. Pat. No. 6,935,710 B2, it discloses a slide rail assembly including a first rail, e.g., an inner rail, a second rail, e.g., a middle rail, and a third rail, e.g., an outer rail. When the first rail is displaced and reaches an extended position relative to the second rail, the first rail is blocked and stopped at the extended position relative to the second rail by two retaining arms. However, such blocking mechanism or function is mandatory. In other words, when the first rail is displaced and reaches the extended position relative to the second rail, the first rail must always be blocked and stopped at the extended position.

Furthermore, in U.S. Pat. No. 10,743,660 B2, it discloses a first rail, e.g., a middle rail, a second rail, e.g., an inner rail, and a third rail, e.g., an outer rail. When the second rail is displaced and reaches a first extended position relative to the first rail, the second rail is blocked and stopped at the first extended position by two members, such as a first blocking member and a second blocking member. When the second rail is displaced and reaches a second extended position relative to the first rail, the second rail is blocked and stopped at the second extended position by another two members, such as a third blocking member and a fourth blocking member. However, such blocking mechanism or function is also mandatory. In other words, when the second rail is displaced and reaches the first extended position relative to the first rail, the second rail must always be blocked and stopped by the first blocking member and the second blocking member at the first extended position, and when the second rail is displaced and reaches the second extended position relative to the first rail, the second rail must always be blocked and stopped by the second blocking member and the third blocking member at the second extended position.

The blocking mechanisms or functions of the aforementioned patents are mandatory and unavoidable. However, in order to meet various requirements, it becomes an important topic to provide a different slide rail product.

SUMMARY OF THE INVENTION

It is an objective of the present invention to provide a slide rail assembly having a first rail, a second rail and an operating member configured to enable or disable a blocking function that stops the second rail at a working position relative to the first rail when the second rail is displaced and reaches a working position relative to the first rail.

According to an aspect of the present invention, a slide rail assembly includes a first rail, a second rail, a resilient member and an operating member. The first rail includes a predetermined feature. The second rail is displaceable relative to the first rail. The resilient member is arranged on the second rail. The operating member is movable relative to the second rail between a first operating position and a second operating position. The operating member at the first operating position is configured to abut against the resilient member to prevent the resilient member from being blocked by the predetermined feature, thereby allowing the resilient member to pass over the predetermined feature as the second rail is displaced relative to the first rail along a first direction or a second direction opposite to the first direction. The operating member at the second operating position is configured not to abut against the resilient member to allow the resilient member to be blocked by the predetermined feature, thereby stopping the second rail at a working position when the second rail is displaced and reaches the working position relative to the first rail along the first direction or the second direction.

According to another aspect of the present invention, a slide rail assembly includes a first rail, a second rail, a resilient member and an operating member. The first rail includes a predetermined feature. The predetermined feature includes a first wall section. The second rail 1 is displaceable relative to the first rail longitudinally. The resilient member is arranged on the second rail. The resilient member includes an auxiliary portion. The operating member is movable relative to the second rail between a first operating position and a second operating position. The operating member at the first operating position is configured to support the resilient member, such that the resilient member accumulates a resilient force in a predetermined state to allow the resilient member to pass over the predetermined feature as the second rail is displaced relative to the first rail away from a first predetermined position along a first direction. The operating member at the second operating position is configured not to support the resilient member, such that the resilient member moves away from the predetermined state in response to the resilient force to allow the auxiliary portion to be blocked by the first wall section of the predetermined feature to stop the second rail at a working position, thereby preventing the second rail from displacing away from the working position along the first direction when the second rail is displaced and reaches the working position relative to the first rail from the first predetermined position along the first direction.

According to another aspect of the present invention, a slide rail assembly includes a first rail, a second rail, a resilient member and an operating member. The first rail includes a predetermined feature. The predetermined feature includes a first wall section. The second rail is displaceable relative to the first rail longitudinally. The resilient member is arranged on the second rail. The resilient member includes an auxiliary portion. The operating member is movable relative to the second rail between a first operating position and a second operating position. The operating member includes a protruding portion. One of the protruding portion of the operating member and the resilient member includes a guiding section. The protruding portion of the operating member at the first operating position is configured to support the resilient member, such that the resilient member accumulates a resilient force in a predetermined state to prevent the auxiliary portion from being blocked by the first wall section of the predetermined feature as the second rail is displaced relative to the first rail from a first predetermined position to a second predetermined position along a first direction. The protruding portion of the operating member at the second operating position is configured not to support the resilient member, such that the resilient member moves from the predetermined state in response to the resilient force to allow the auxiliary portion to be blocked by the first wall section of the predetermined feature to stop the second rail at a working position, thereby preventing the second rail from displacing from the working position to the second predetermined position along the first direction when the second rail is displaced and reaches the working position relative to the first rail along the first direction. When the second rail is located at the working position relative to the first rail, the operating member moving from the second operating position to the first operating position drives the resilient member by the guiding section and supports the resilient member by the protruding portion to prevent the auxiliary portion of the resilient member from being blocked by the first wall section of the predetermined feature, thereby allowing the second rail to displace from the working position to the second predetermined position along the first direction.

In summary, the slide rail assembly of the present invention is provided with the operating member configured to enable or disable a blocking function that stops the second rail at the working position relative to the first rail when the second rail is displaced and reaches a working position relative to the first rail. Therefore, the present invention offers convenience and flexibility in operation.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
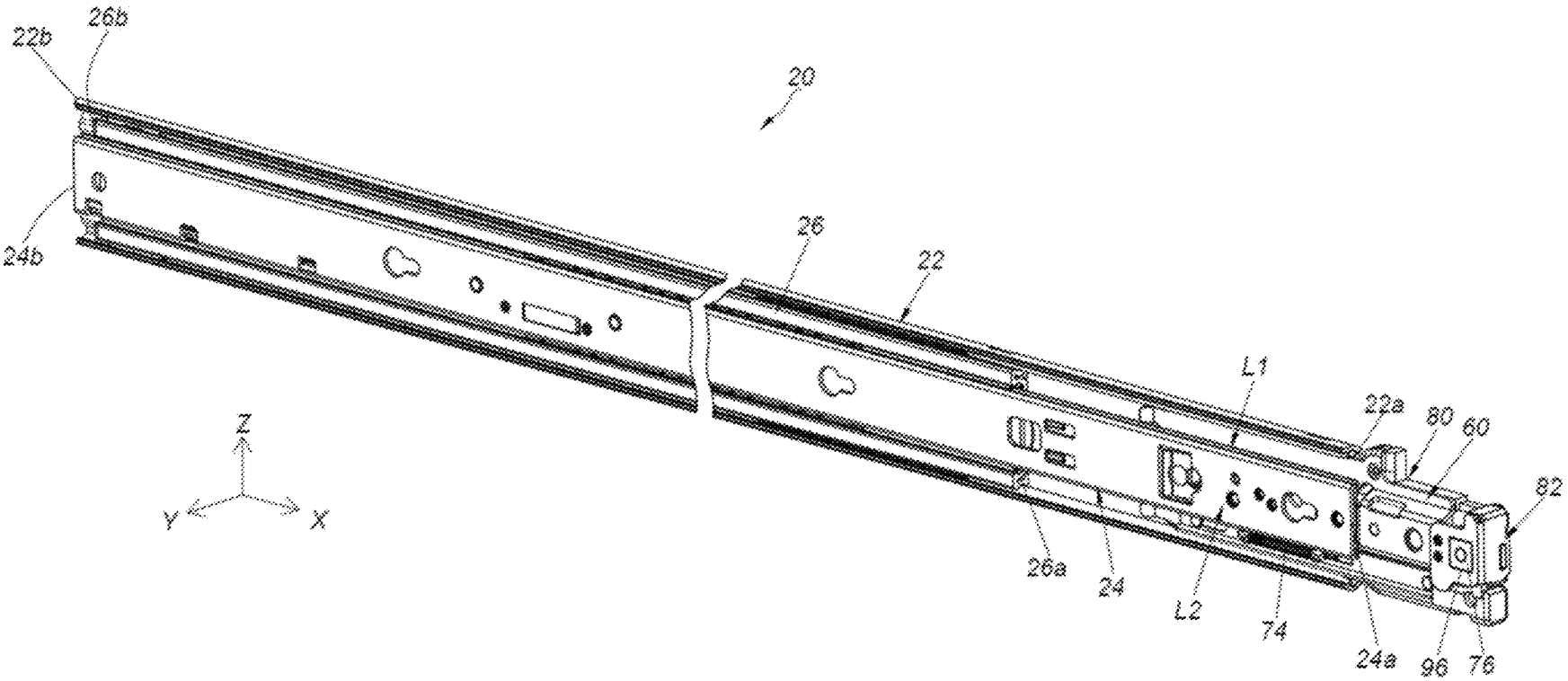
FIG. 1 is a schematic diagram of a slide rail assembly according to a first embodiment of the present invention.
Figure 2:
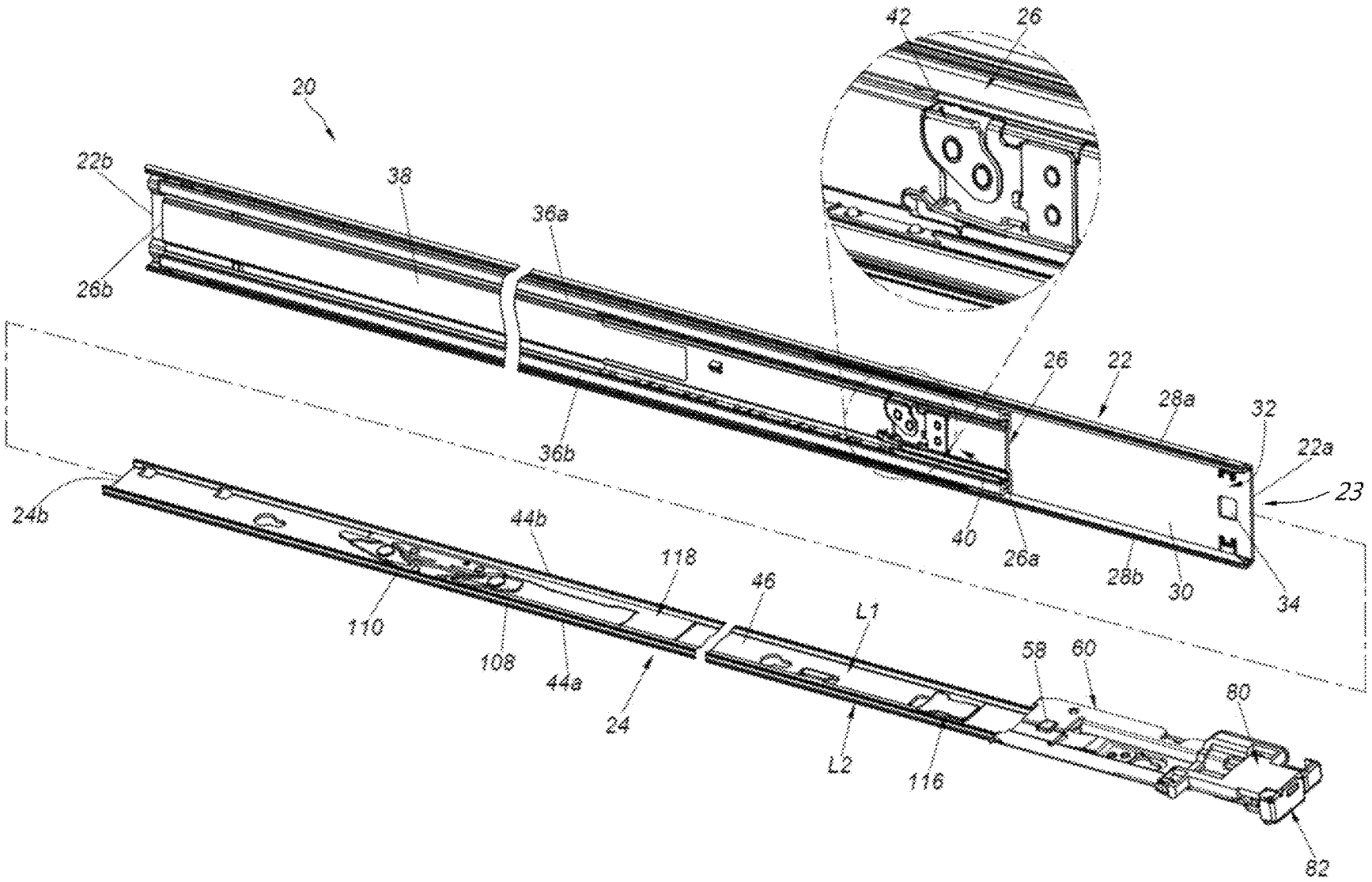
FIG. 2 is an exploded diagram of the slide rail assembly according to the first embodiment of the present invention.
Figure 3:
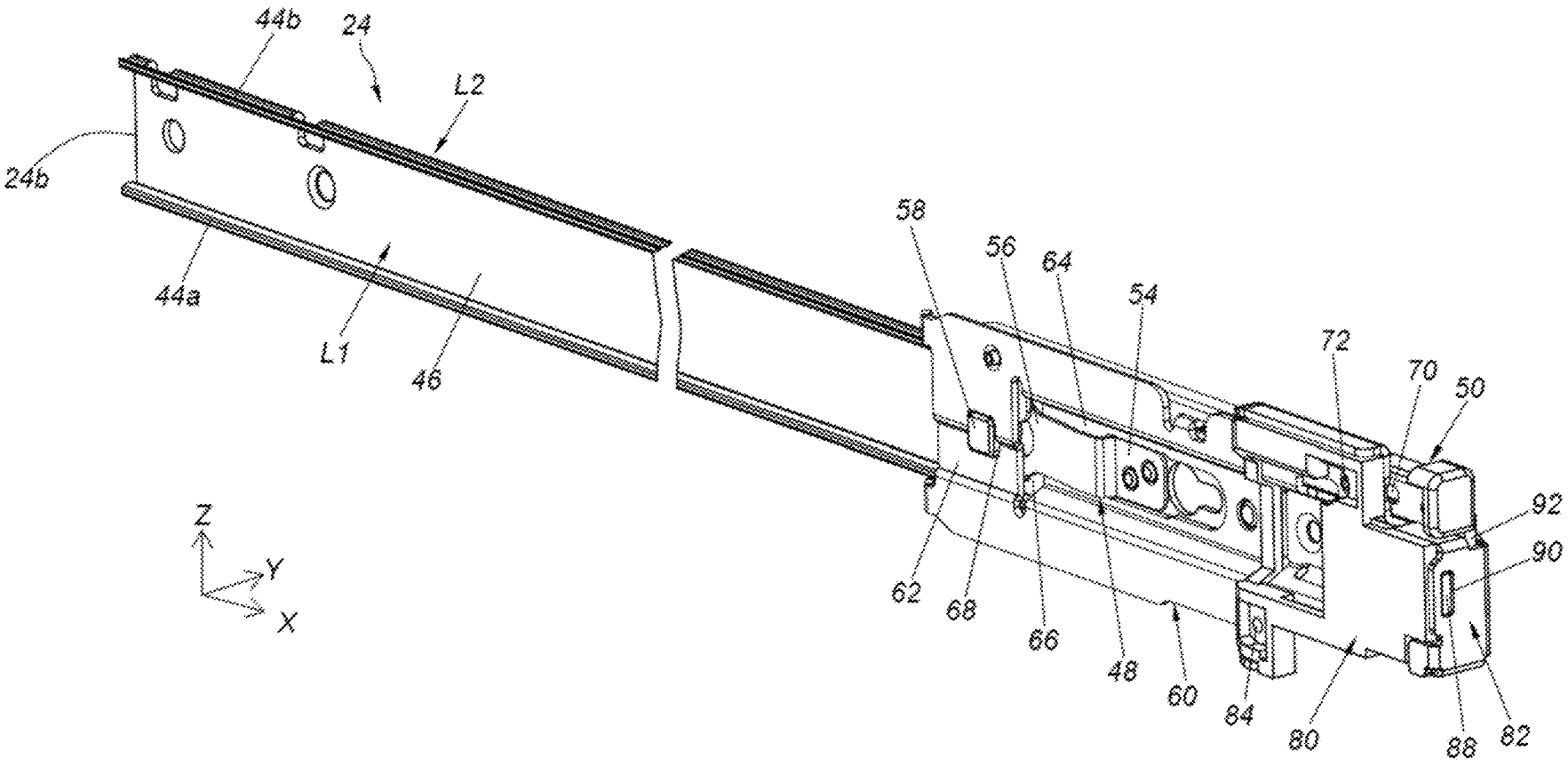
FIG. 3 is a partial diagram of the slide rail assembly according to the first embodiment of the present invention.

As shown in FIG. 1 and FIG. 2, in a first embodiment, a slide rail assembly 20 includes a first rail 22 and a second rail 24. Preferably, the slide rail assembly 20 further includes a third rail 26 movably mounted between the first rail 22 and the second rail 24. The first rail 22, the second rail 24 and the third rail 26 are displaceable relative to one another along a longitudinal direction. In this embodiment, the longitudinal direction can be defined by a length direction of a slide rail, e.g., the first rail 22, the second rail 24 or the third rail 26, and parallel to an X axis. A transverse direction can be defined by a lateral direction or a width direction of the slide rail, e.g., the first rail 22, the second rail 24 or the third rail 26, and parallel to a Y axis. A vertical direction can be defined by a height direction of the slide rail, e.g., the first rail 22, the second rail 24 or the third rail 26. Besides, preferably, in this embodiment, by way of example, the first rail 22, the second rail 24 and the third rail 26 can be an outer rail, an inner rail and a middle rail, respectively. However, the present invention is not limited to this embodiment.

The first rail 22 includes a first wall 28*a*, a second wall 28*b* and a longitudinal wall 30 connected between the first wall 28*a* and the second wall 28*b* of the first rail 22, and the first wall 28*a*, the second wall 28*b* and the longitudinal wall 30 of the first rail 22 cooperatively define a first channel 32 configured to receive the third rail 26 and a part of the second rail 24. The first rail 22 includes a first end 22*a* and a second end 22*b* opposite to the first end 22*a*. For example, the first end 22*a* and the second end 22*b* of the first rail 22 can be a front end and a rear end of the first rail 22, respectively. Furthermore, the longitudinal wall 30 of the first rail 22 includes s a predetermined feature 34. Preferably, the predetermined feature 34 is located adjacent to the first end 22*a* of the first rail 22. In this embodiment, by way of example, the predetermined feature 34 can be an opening defined by a plurality of wall sections. However, the present invention is not limited to this embodiment.

The third rail 26 includes a first wall 36*a*, a second wall 36*b* and a longitudinal wall 38 connected between the first wall 36*a* and the second wall 36*b* of the third rail 26, and the first wall 36*a*, the second wall 36*b* and the longitudinal wall 38 of the third rail 26 cooperatively define a second channel 40 configured to receive the second rail 24. The third rail 26 includes a first end 26*a* and a second end 26*b* opposite to the first end 26*a*. For example, the first end 26*a* and the second end 26*b* of the third rail 26 can be a front end and a rear end of the third rail 26, respectively. Preferably, the third rail 26 further includes an auxiliary feature 42. In this embodiment, by way of example, the auxiliary feature 42 can be a protruding portion located adjacent to the first end 26*a* of the third rail 26. However, the present invention is not limited to this embodiment. Besides, the auxiliary feature 42 can be arranged on the longitudinal wall 38 of the third rail 26 directly or indirectly.

The second rail 24 includes a first wall 44*a*, a second wall 44*b* and a longitudinal wall 46 connected between the first wall 44*a* and the second wall 44*b* of the second rail 24. The second rail 24 includes a first end 24*a* and a second end 24*b* opposite to the first end 24*a*. For example, the first end 24*a* and the second end 24*b* of the second rail 24 can be a front end and a rear end of the second rail 24, respectively. Besides, the second rail 24 includes a first side L1 and a second side L2 opposite to the first side L1. For example, the first side L1 and the second side L2 of the second rail 24 can be an outer side and an inner side of the second rail 24, respectively, and the first side L1 of the second rail 24 can face toward the first rail 22 and/or the third rail 26.

Figure 9:
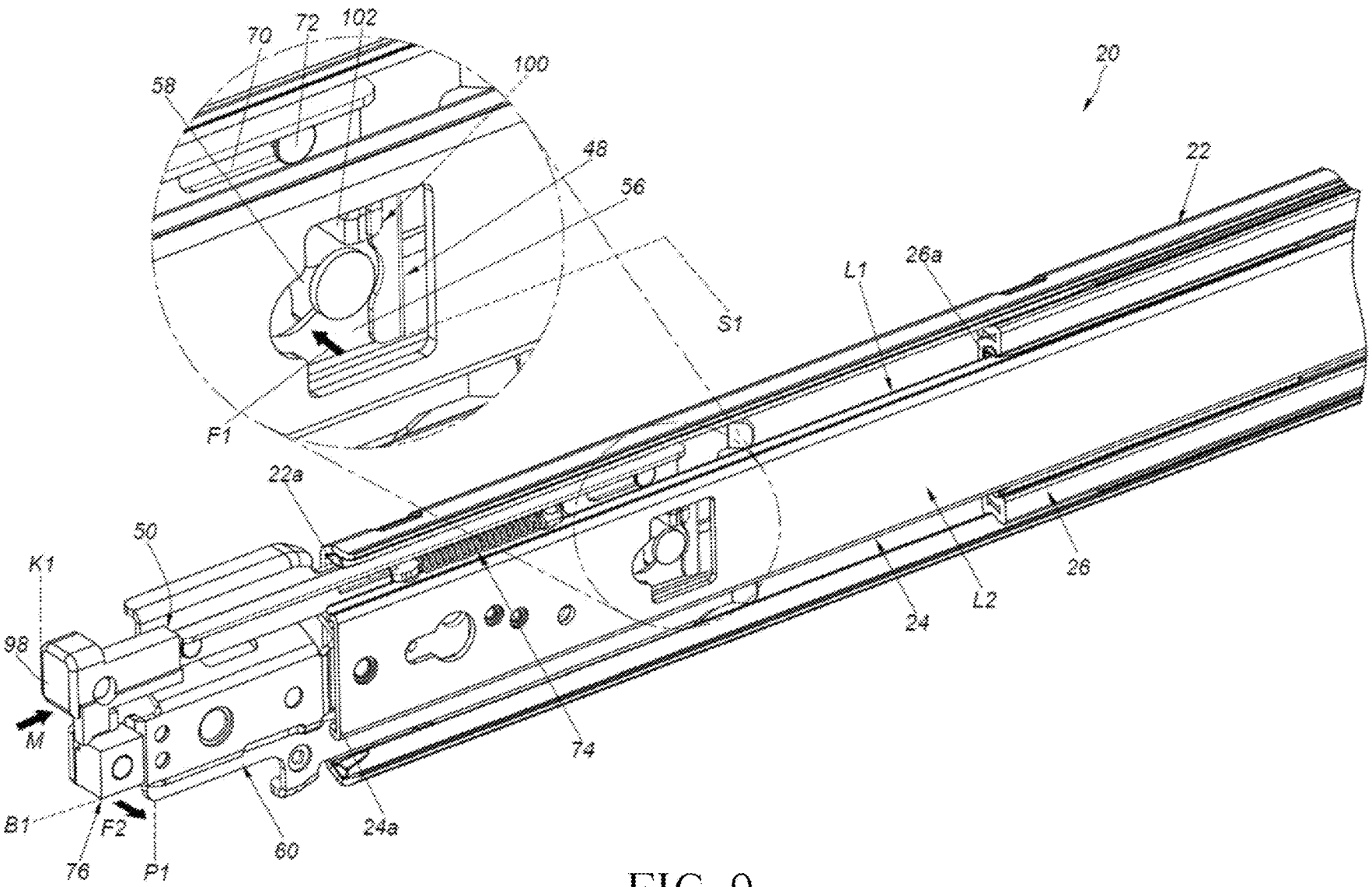
FIG. 9 is a diagram of the slide rail assembly with a first rail at a retracted position and the operating member at the first operating position from the second perspective according to the first embodiment of the present invention.
Figure 10:
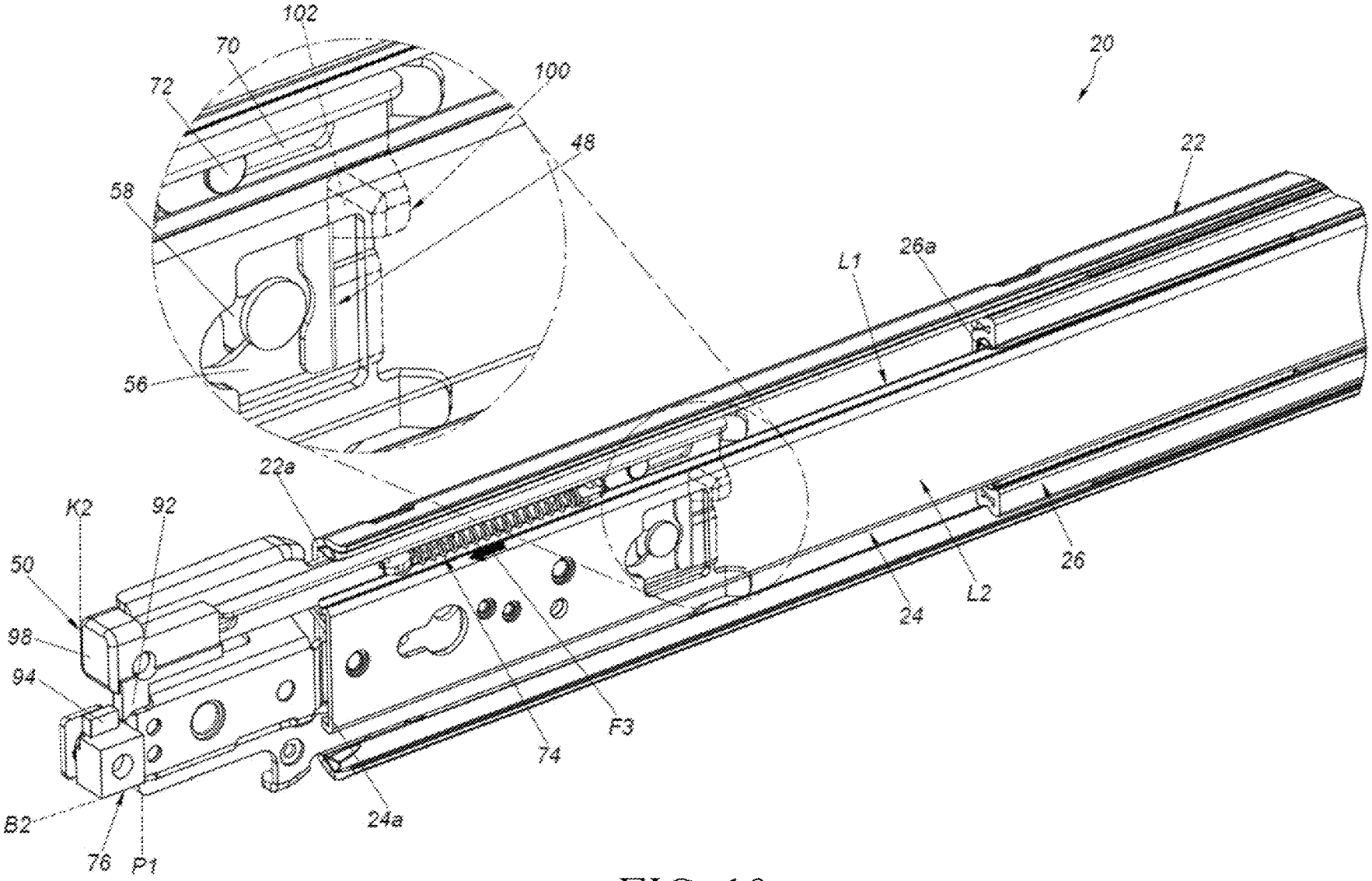
FIG. 10 is a diagram of the slide rail assembly with the first rail at the retracted position and the operating member at the second operating position from the second perspective according to the first embodiment of the present invention.
Figure 13:
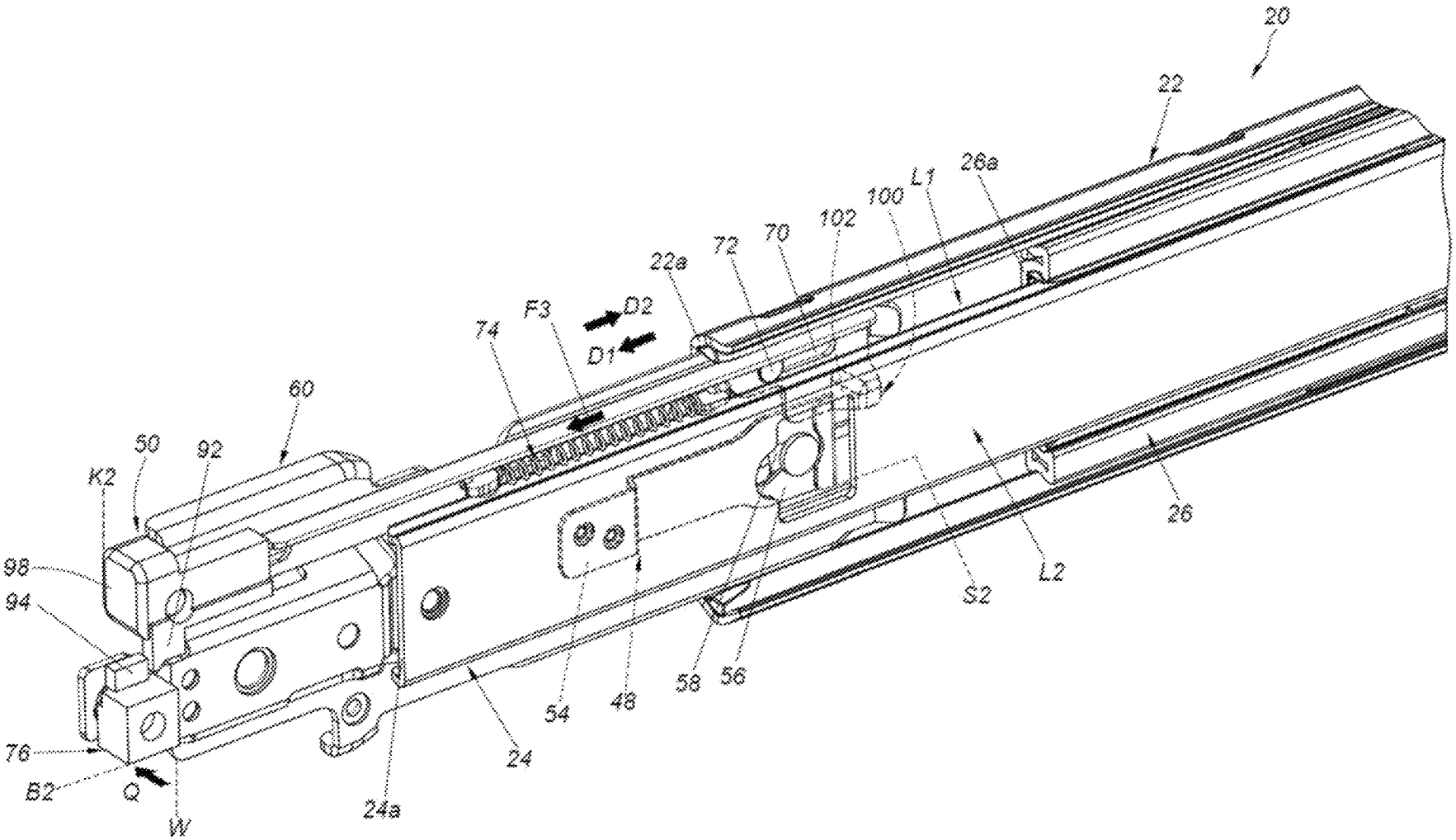
FIG. 13 is a diagram of the slide rail assembly with the first rail at the working position and the operating member at the second operating position from the second perspective according to the first embodiment of the present invention.
Figure 14:
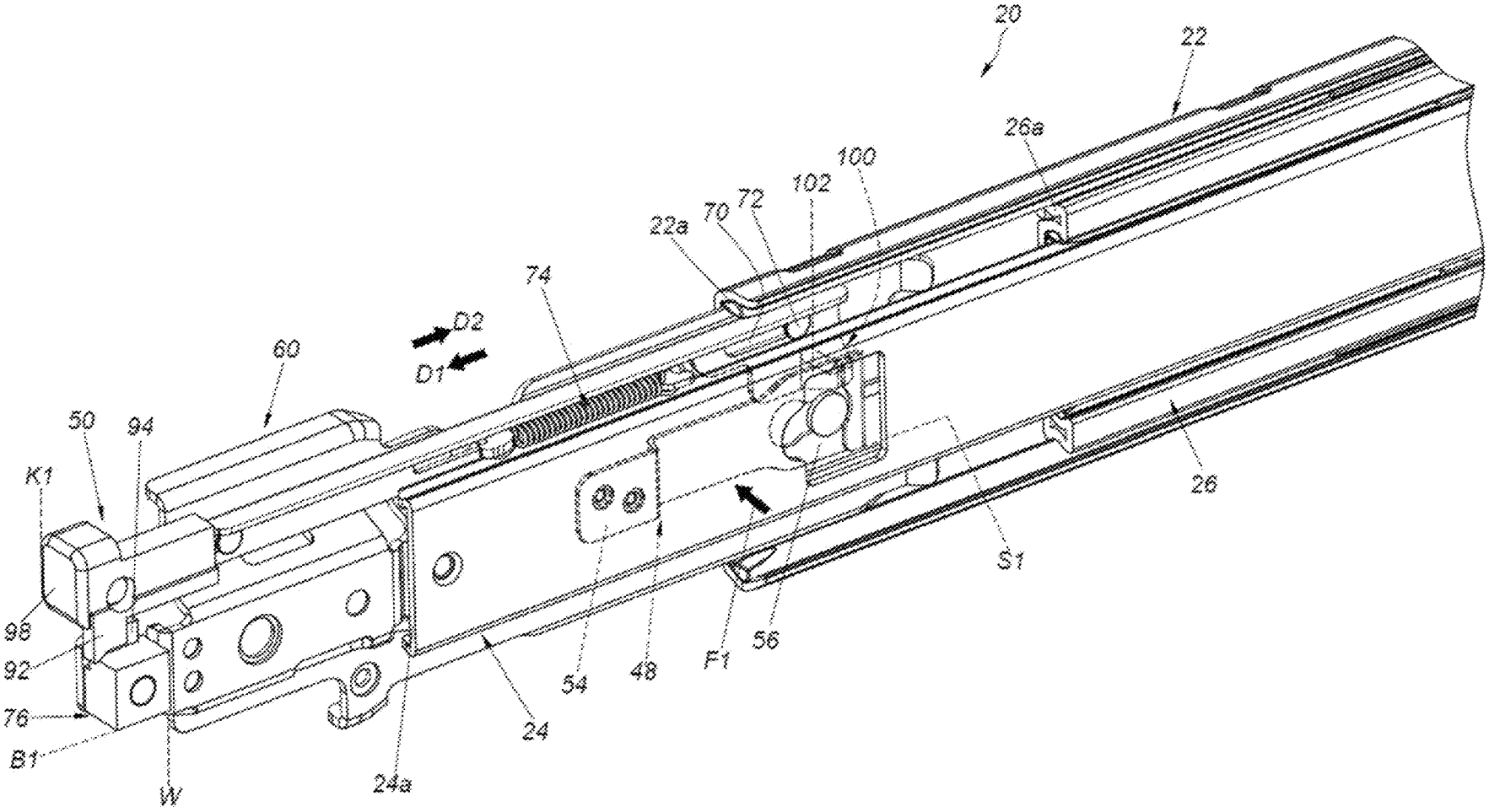
FIG. 14 is a diagram of the slide rail assembly with the first rail at the working position and the operating member at the first operating position from the second perspective according to the first embodiment of the present invention.

As shown in FIG. 3, FIG. 4, FIG. 9, FIG. 10, FIG. 13 and FIG. 14, a mechanical control device is arranged on the second rail 24 for enabling or disenabling a blocking function that stops the second rail 24 at a working position W (as shown in FIG. 13 and FIG. 14) when the second rail 24 is displaced from a first predetermined position P1 (as shown in FIG. 9 and FIG. 10), e.g., a retracted position, and reaches the working position W (as shown in FIG. 13 and FIG. 14). In this embodiment, the mechanical control device can include a resilient member 48 and an operating member 50. The resilient member 48 is connected to the second rail 24, and the operating member 50 is movable relative to the second rail 24.

Preferably, in this embodiment, by way of example, the resilient member 48 can be a resilient clip. However, the present invention is not limited to this embodiment. The second rail 24 includes a predetermined hole 52 communicated with the first side L1 and the second side L2 of the second rail 24. The resilient member 48 includes a connecting portion 54 and a resilient arm 56 extending from the connecting portion 54. The connecting portion 54 is connected, e.g., fixedly connected, to the first side L1 of the second rail 24. The predetermined hole 52 of the second rail 24 is located at a position corresponding to the resilient arm 56 for providing a moving space for the resilient arm 56. An auxiliary portion 58 is arranged on the resilient arm 56. In this embodiment, by way of example, the auxiliary portion 58 can be a protrusion or a protruding structure. However, the present invention is not limited to this embodiment.

Preferably, an extending member 60 is disposed on the second rail 24. Furthermore, the extending member 60 is connected, e.g., fixedly connected, to the first side L1 of the second rail 24 and can be considered as a part of the second rail 24, and the extending member 60 is located adjacent to the first end 24*a* of the second rail 24. Specifically, the extending member 60 includes a first extending portion 62 and a second extending portion 64, and a mounting space 66 is defined between the first extending portion 62 and the second extending portion 64. Furthermore, the first extending portion 62 and the second extending portion 64 are spaced apart from each other by a transverse distance, so as to form the mounting space 66. The first extending portion 62 includes a corresponding hole 68. The resilient arm 56 of the resilient member 48 stretches into the mounting space 66 along the longitudinal direction. The auxiliary portion 58 is aligned with the corresponding hole 68 in the transverse direction. The first extending portion 62 and the second extending portion 64 are configured to restrict resilient movement of the resilient arm 56 of the resilient member 48 within a limited range. The operating member 50 is movably mounted on the extending member 60 of the second rail 24.

Preferably, the operating member 50 is movable relative to the second rail 24 along the longitudinal direction. Furthermore, a plurality of longitudinal holes 70 are formed on one of the operating member 50 and the extending member 60 of the second rail 24, and a plurality of protruding objects 72 are arranged on the other one of the operating member 50 and the extending member 60 of the second rail 24. Each of the plurality of protruding objects 72 is configured to pass through a portion of a corresponding one of the plurality of longitudinal holes 70 for restricting movement of the operating member 50 relative to the second rail 24 within a limited range. In this embodiment, by way of example, the plurality of protruding objects 72 can be connected to the extending member 60 of the second rail 24, and the plurality of longitudinal holes 70 can be formed on the operating member 50.

Preferably, the slide rail assembly 20 further includes a recovering resilient member 74 configured to provide a recovering resilient force to the operating member 50.

Preferably, the slide rail assembly 20 further includes a button member 76 and an auxiliary resilient member 78. The button member 76 is movably mounted on the extending member 60 of the second rail 24, and the auxiliary resilient member 78 is configured to provide a resilient force to the button member 76.

Preferably, the slide rail assembly 20 further includes a first shell body 80 and a second shell body 82. The first shell body 80 and the second shell body 82 are configured, for example, to ensure stability and reliability of the operating member 50 and/or the button member 76 when being mounted on the extending member 60 of the second rail 24. Specifically, the first shell body 80 includes a first mounting feature 84 configured to be connected to a second mounting feature 86 of the extending member 60 of the second rail 24. In this embodiment, by way of example, the first mounting feature 84 can be connected to the second mounting feature 86 by a rivet member or a threaded member. However, the present invention is not limited to this embodiment. The first shell body 80 and the second shell body 82 are detachably connected to each other by a first mounting portion 88 and a second mounting portion 90. In this embodiment, by way of example, the first mounting portion 88 and the second mounting portion 90 can be an engaging protrusion and an engaging recess configured to be engaged with the engaging protrusion, respectively. However, the present invention is not limited to this embodiment. Furthermore, the operating member 50 further includes a first predetermined portion 92 configured to pass through a predetermined space 93 of the second shell body 82 for cooperating with a second predetermined portion 94 of the button member 76. Besides, the second shell body 82 further includes an auxiliary hole 96 for allowing the button member 76 to pass therethrough (as shown in FIG. 1), and an inner wall of the second shell body 82 is configured to abut against the button member 76 for restricting movement of the button member 76 within a limited range.

Figure 5:
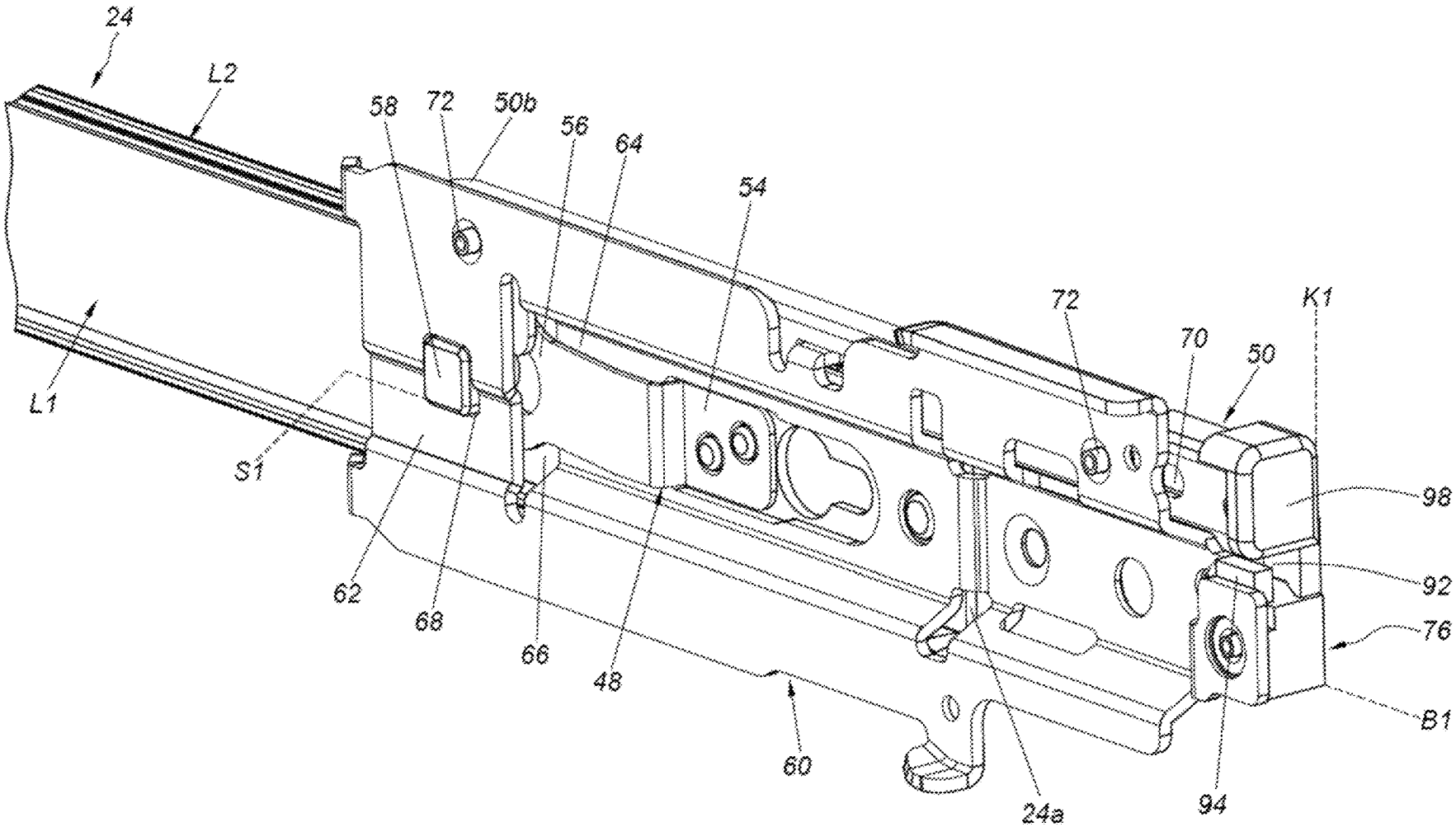
FIG. 5 is a partial diagram of the slide rail assembly with an operating member at a first operating position from a first perspective according to the first embodiment of the present invention.
Figure 6:
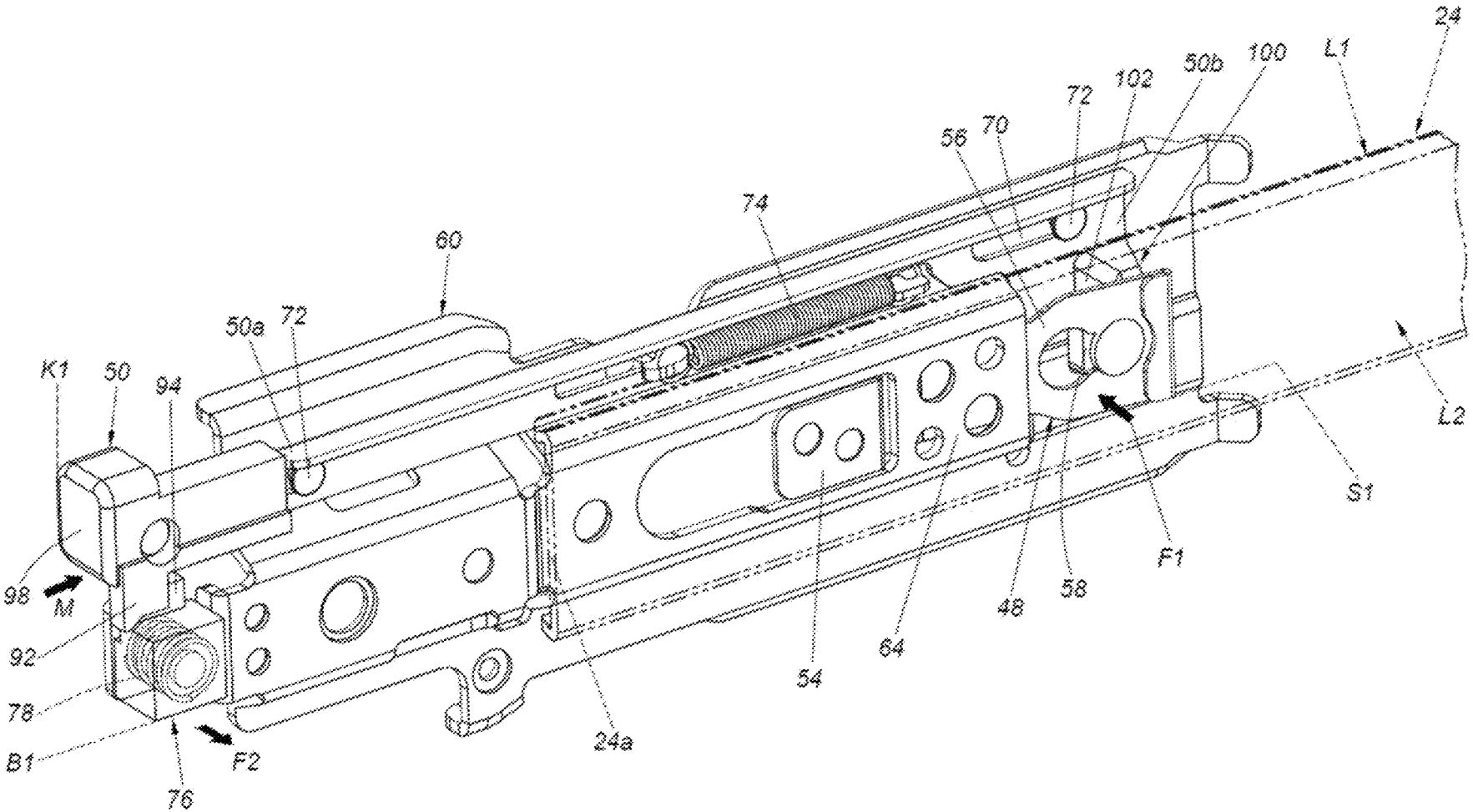
FIG. 6 is a partial diagram of the slide rail assembly with the operating member at the first operating position from a second perspective according to the first embodiment of the present invention.

As shown in FIG. 5 and FIG. 6, the operating member 50 includes a first end 50*a* and a second end 50*b*. For example, the first end 50*a* and the second end 50*b* of the operating member 50 can be a front end and a rear end of the operating member 50, respectively. The operating member 50 further includes an operating portion 98 and a protruding portion 100. The operating portion 98 is connected and located adjacent to the first end 50*a* of the operating member 50, and the protruding portion 100 is connected and located adjacent to the second end 50*b* of the operating member 50. One of the protruding portion 100 and the resilient member 48 includes a guiding section 102. In this embodiment, by way of example, the protruding portion 100 can include the guiding section 102, and the guiding section 102 can be an inclined surface or an arc surface. However, the present invention is not limited to this embodiment.

Furthermore, the operating member 50 can move to a first operating position K1 relative to the second rail 24. As shown in FIG. 6, when the operating member 50 is located at the first operating position K1, the protruding portion 100 of the operating member 50 is configured to support the resilient member 48, e.g., by abutment of the protruding portion 100 of the operating member 50 and the resilient arm 56 of the resilient member 48, to maintain the resilient member 48 in a first predetermined state S1, such that the resilient arm 56 of the resilient member 48 accumulates a resilient force F1 oriented toward the longitudinal wall 30 of the first rail 22. Besides, as shown in FIG. 5, when the resilient member 48 is in the first predetermined state S1, the auxiliary portion 58 is partially located within the corresponding hole 68 and does not protrude out of the corresponding hole 68.

Preferably, the first predetermined portion 92 of the operating member 50 extends from the operating portion 98. As shown in FIG. 6, when the operating member 50 is located at the first operating position K1, the operating member 50 is configured to hold the button member 76 in a non-blocking state B1, such that the auxiliary resilient member 78 accumulates an auxiliary resilient force F2 oriented opposite to the resilient force F1, e.g., by abutment of the first predetermined portion 92 of the operating member 50 and the second predetermined portion 94 of the button member 76.

Figure 7:
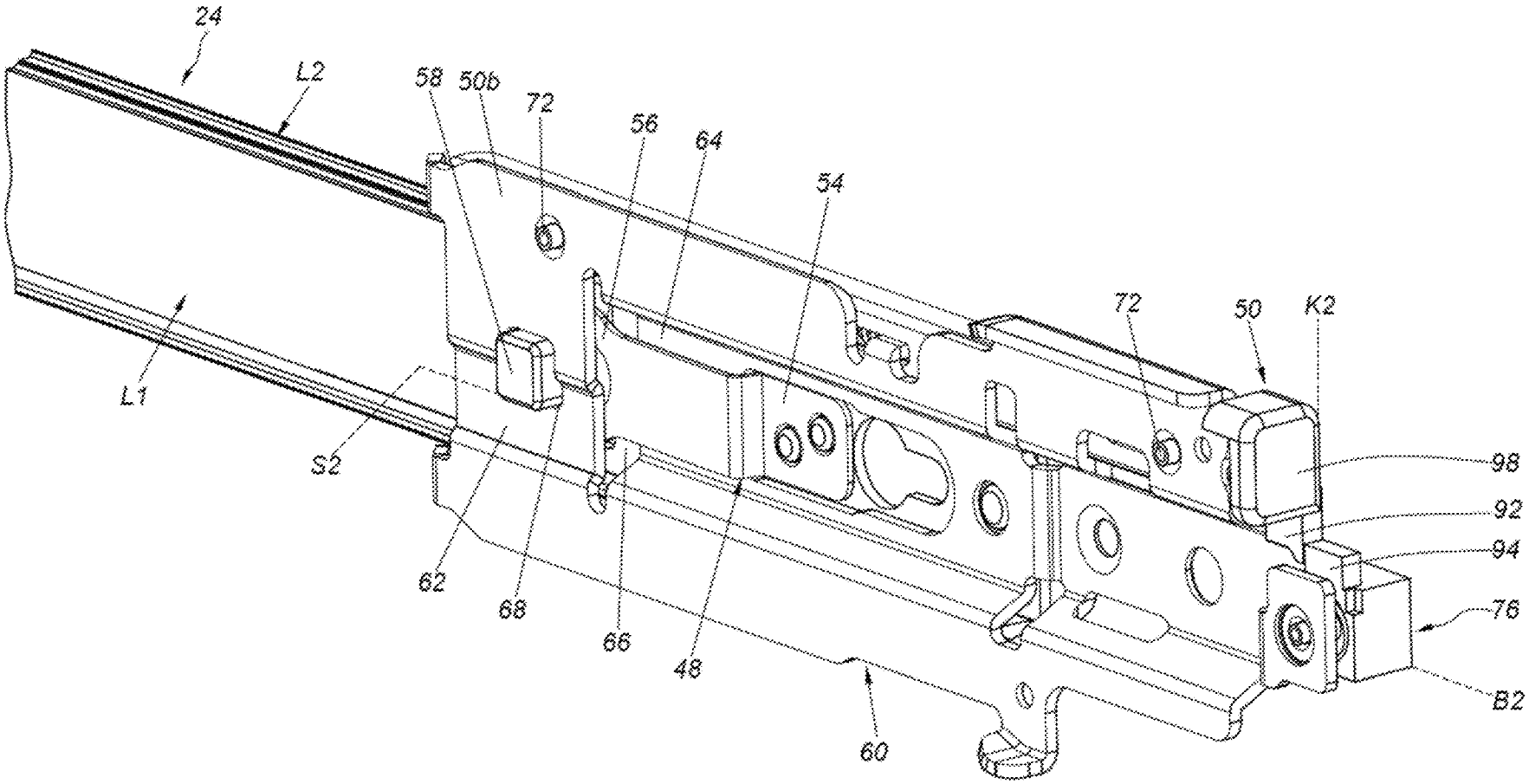
FIG. 7 is a partial diagram of the slide rail assembly with the operating member at a second operating position from the first perspective according to the first embodiment of the present invention.
Figure 8:
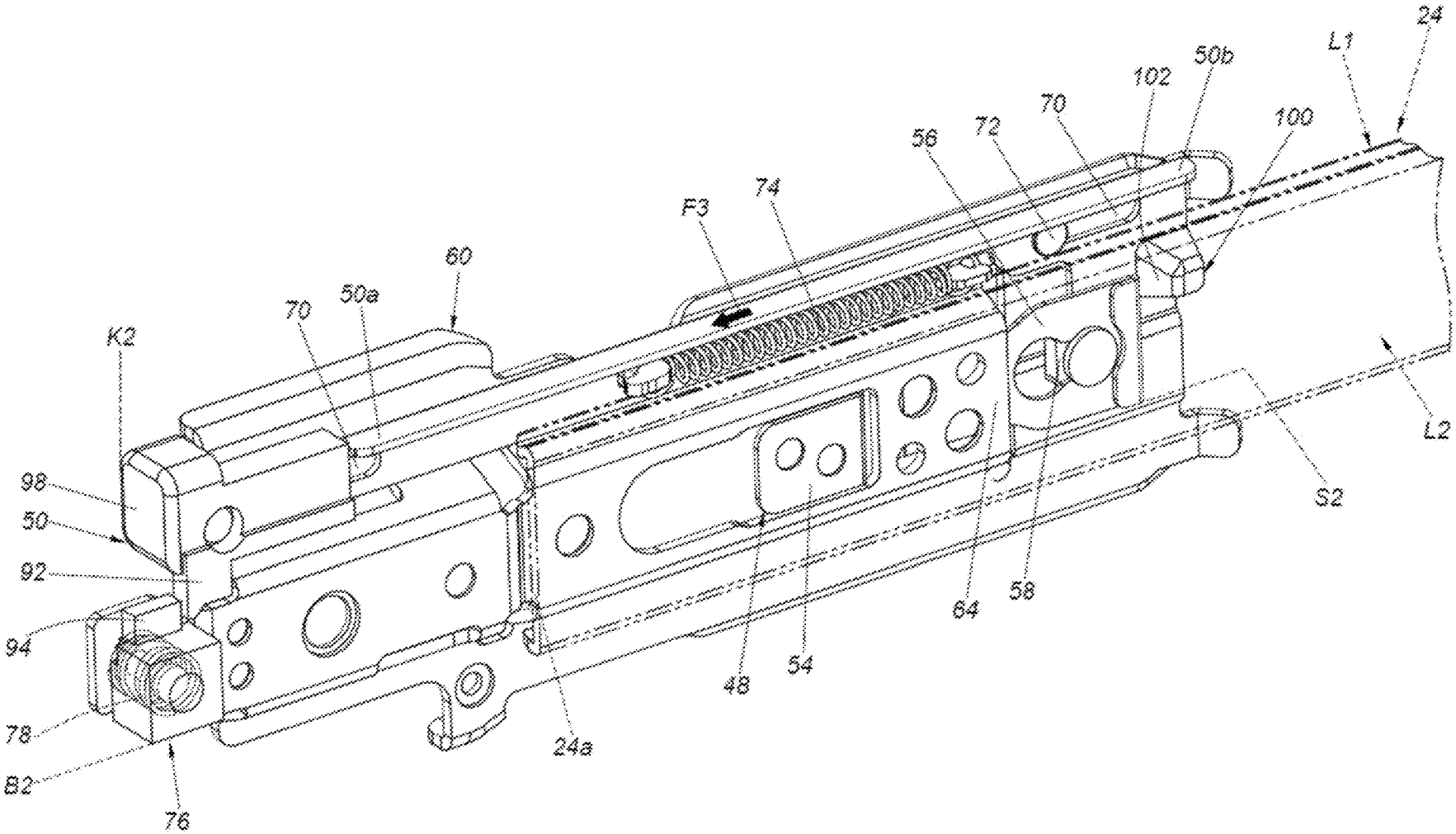
FIG. 8 is a partial diagram of the slide rail assembly with the operating member at the second operating position from the second perspective according to the first embodiment of the present invention.

As shown in FIG. 7 and FIG. 8, the operating member 50 further can move to a second operating position K2 relative to the second rail 24. For example, the operating member 50 can move from the first operating position K1 (as shown in FIG. 6) to the second operating position K2 (as shown in FIG. 8) along the longitudinal direction by operating the operating portion 98 of the operating member 50 with a predetermined force M along a first predetermined operating direction. As shown in FIG. 8, when the operating member 50 is located at the second operating position K2, the recovering resilient member 74 accumulates a recovering resilient force F3, and the protruding portion 100 of the operating member 50 no longer supports the resilient member 48, e.g., the protruding portion 100 of the operating member 50 and the resilient arm 56 of the resilient member 48 are separated from each other by a longitudinal distance. Accordingly, the resilient member 48 moves away from the first predetermined state S1 in response to the resilient force F1, e.g., to a second predetermined state S2 (as shown in FIG. 8), and the auxiliary portion 58 protrudes out of the corresponding hole 68 (as shown in FIG. 7).

Preferably, when the operating member 50 is located at the second operating position K2, the first predetermined portion 92 of the operating member 50 is not in contact with the second predetermined portion 94 of the button member 76, thereby allowing the button member 76 to move from the non-blocking state B1 to a blocking state B2 (as shown in FIG. 10) along the transverse direction in response to the auxiliary resilient force F2 provided by the auxiliary resilient member 78. When the operating member 50 is located at the second operating position K2 and the button member 76 is in the blocking state B2, the second predetermined portion 94 of the button member 76 is configured to block the first predetermined portion 92 of the operating member 50 along the longitudinal direction, such that the operating member 50 is maintained at the second operating position K2 and the recovering resilient member 74 keeps accumulating the recovering resilient force F3.

When the slide rail assembly 20 is in a state as shown in FIG. 9, the second rail 24 is located at the first predetermined position P1, e.g., the retracted position, relative to the first rail 22, and the operating member 50 is located at the first operating position K1. In other words, when the slide rail assembly 20 is in the state as shown in FIG. 9, the protruding portion 100 of the operating member 50 is configured to support the resilient member 48, e.g., by the abutment of the protruding portion 100 of the operating member 50 and the resilient arm 56 of the resilient member 48, to maintain the resilient member 48 in the predetermined state S1, such that the resilient arm 56 accumulates the resilient force F1 oriented toward the longitudinal wall 30 of the first rail 22 (as shown in FIG. 6 and FIG. 9).

It should be noticed that the operating member 50 is operably moved to the second operating position K2 for enabling the blocking function that stops the second rail 24 at the working position W (as shown FIG. 12) when the second rail 24 is displaced from the first predetermined position P1, e.g., the retracted position (as shown in FIG. 9) and reaches the working position W.

Figure 11:
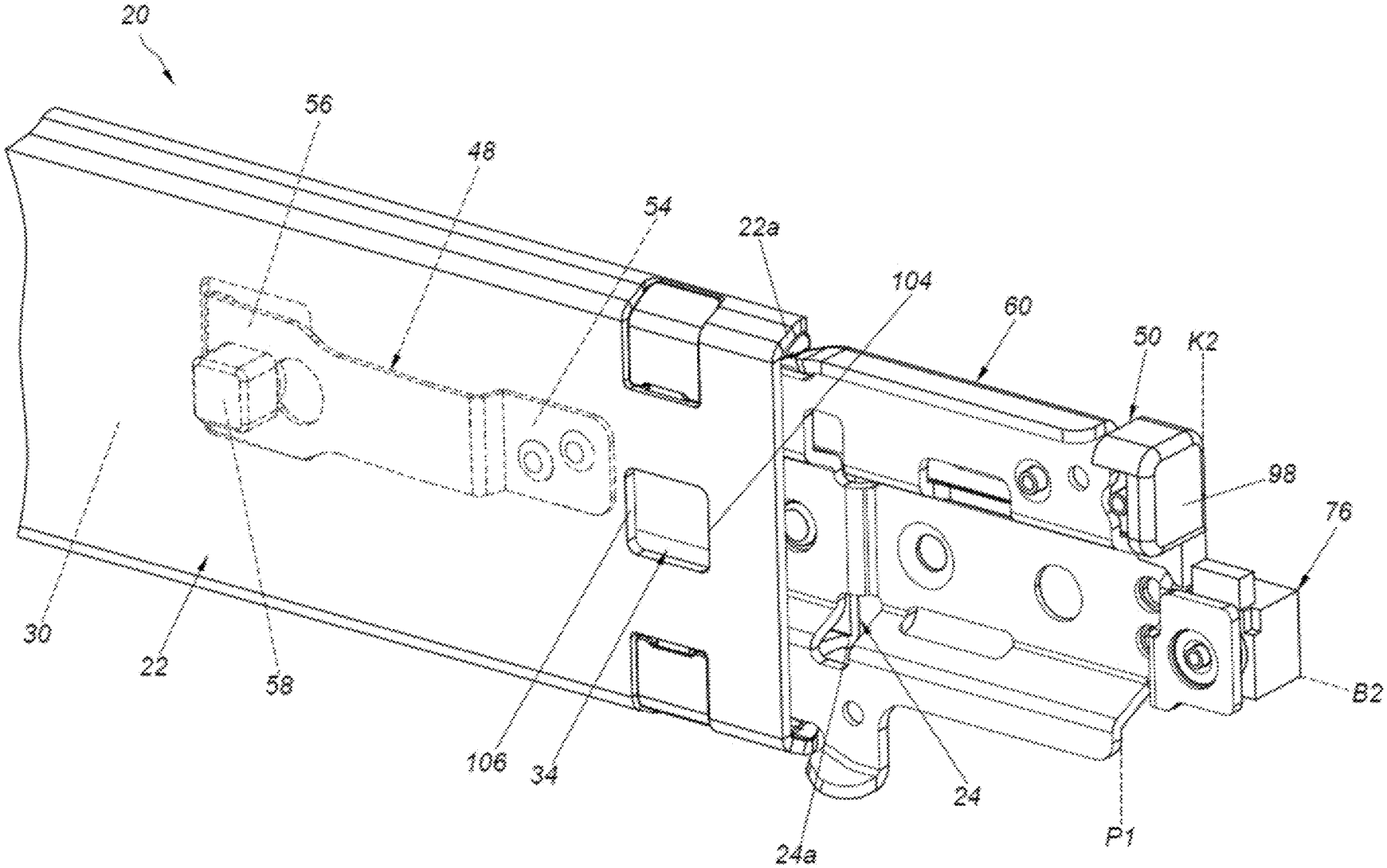
FIG. 11 is a diagram of the slide rail assembly with the first rail at the retracted position and the operating member at the second operating position from the first perspective according to the first embodiment of the present invention.

As shown in FIG. 9, when the second rail 24 is located at the first predetermined position P1 relative to the first rail 22 and the operating member 50 is located at the first operating position K1, the blocking function of stopping the second rail 24 at the working position W is disabled, i.e., the mechanical control device does not cooperate with the longitudinal wall 30 of the first rail 22. As shown in FIG. 10 and FIG. 11, when the operating portion 98 of the operating member 50 is operated with the predetermined force M to move the operating member 50 from the first operating position K1 to the second operating position K2 along the longitudinal direction, the recovering resilient member 74 accumulates the recovering resilient force F3, and the protruding portion 100 of the operating member 50 no longer supports the resilient member 48, e.g., the protruding portion 100 of the operating member 50 and the resilient arm 56 of the resilient member 48 are separated from each other by the longitudinal distance. Accordingly, the resilient member 48 moves away from the first predetermined state S1 in response to the resilient force F1 to drive the auxiliary portion 58 on the resilient arm 56 of the resilient member 48 to abut against the longitudinal wall 30 of the first rail 22.

Figure 12:
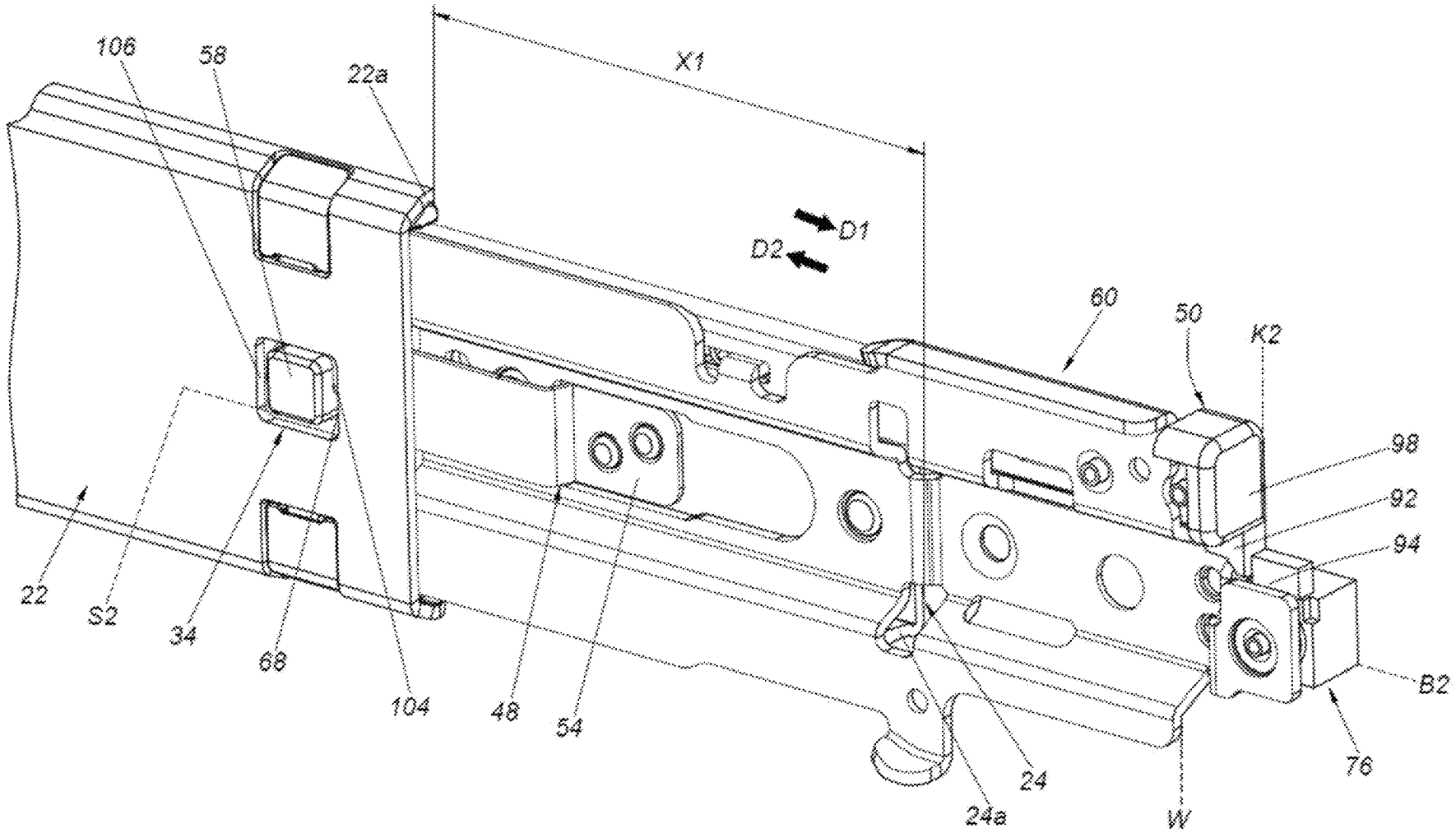
FIG. 12 is a diagram of the slide rail assembly with the first rail at a working position and the operating member at the second operating position from the first perspective according to the first embodiment of the present invention.

As shown in FIG. 12 and FIG. 13, when the operating member 50 is located at the second operating position K2, the blocking function of stopping the second rail 24 at the working position W is enabled, i.e., the mechanical control device can cooperate with the predetermined feature 34 of the longitudinal wall 30 of the first rail 22. Specifically, when the second rail 24 is displaced away from the first predetermined position P1 along a first direction D1 and reaches the working position W between the first predetermined position P1 and a second predetermined position P2, e.g., a fully extended position, the auxiliary portion 58 of the resilient member 48 can be blocked by a first wall section 104 of the predetermined feature 34 to stop the second rail 24 at the working position W, thereby preventing the second rail 24 from displacing from the working position W to the second predetermined position P2. More specifically, when the second rail 24 is displaced from the first predetermined position P1 along the first direction D1 and reaches the working position W, the resilient member 48 moves to the second predetermined state S2 in response to the resilient force F1, such that the auxiliary portion 58 protrudes out of the corresponding hole 68 to stretch into the predetermined feature 34 of the longitudinal wall 30 of the first rail 22 and the auxiliary portion 58 is blocked by the first wall section 104 of the predetermined feature 34, thereby stopping the second rail 24 at the working position W (as shown in FIG. 12 and FIG. 13).

Preferably, the predetermined feature 34 further includes a second wall section 106 opposite to the first wall section 104. As shown in FIG. 12 and FIG. 13, when the second rail 24 is located at the working position W and the operating member 50 is located at the second operating position K2, the auxiliary portion 58 stretching into the predetermined feature 34 of the longitudinal wall 30 of the first rail 22 is blocked by the second wall section 106 of the predetermined feature 34, thereby preventing the second rail 24 from displacing from the working position W to the first predetermined position P1 along a second direction D2 opposite to the first direction D1.

Figure 15:
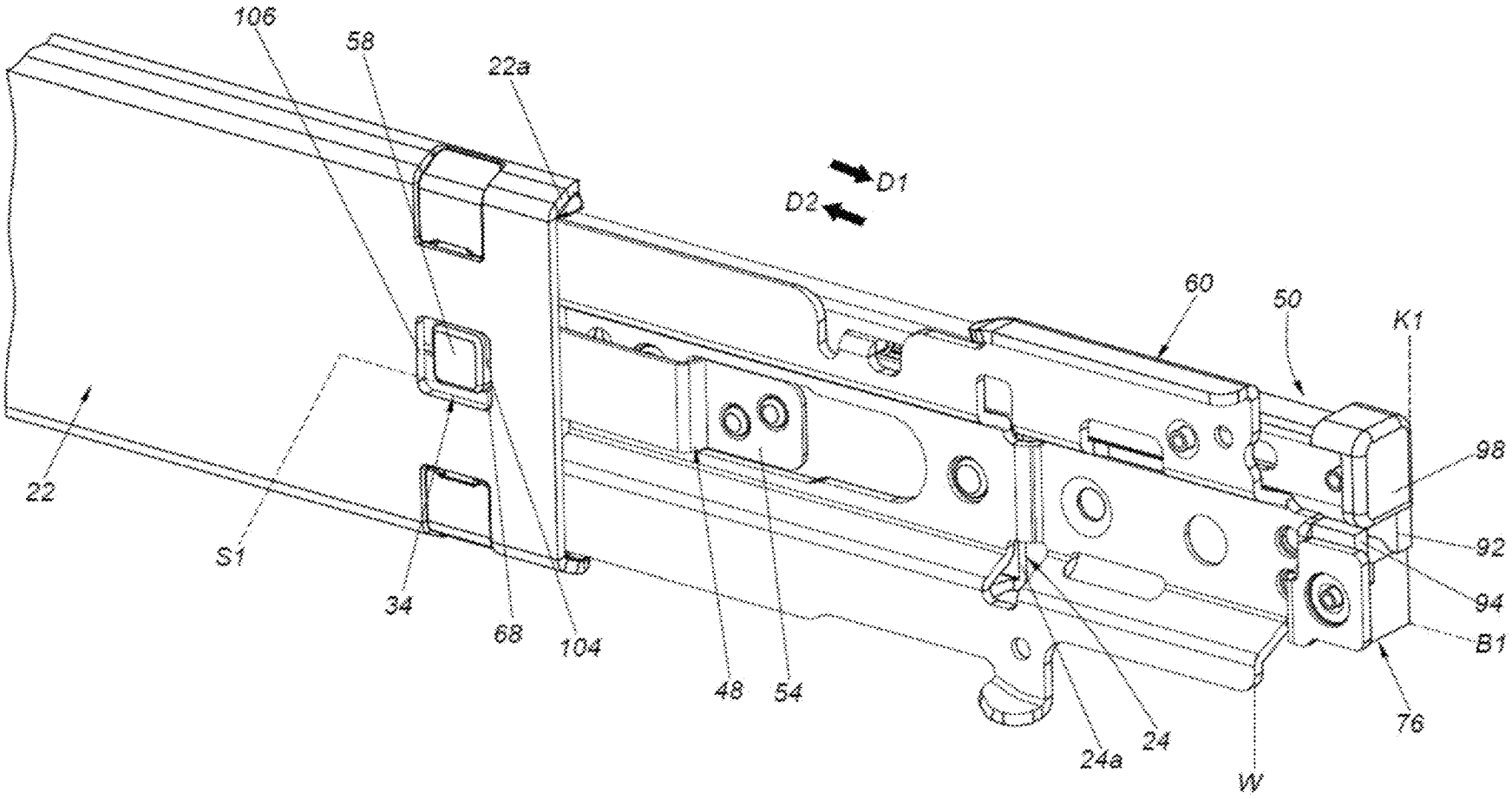
FIG. 15 is a diagram of the slide rail assembly with the first rail at the working position and the operating member at the first operating position from the first perspective according to the first embodiment of the present invention.

As shown in FIG. 12 to FIG. 15, when it is desired to terminate a blocking relationship between the auxiliary portion 58 of the resilient member 48 in the second predetermined state S2 and the predetermined feature 34 of the first rail 22, the button member 76 can be operated with a force Q that overcomes the auxiliary resilient force F2, so as to return from the blocking state B2 (as shown in FIG. 12 and FIG. 13) back to the non-blocking state B1 (as shown in FIG. 14 and FIG. 15) for preventing the first predetermined portion 92 of the operating member 50 from being blocked by the second predetermined portion 94 of the button member 76. Accordingly, the operating member 50 can return from the second operating position K2 back to the first operating position K1 in response to the recovering resilient force F3 provided by the recovering resilient member 74. When the operating member 50 returns from the second operating position K2 back to the first operating position K1, the operating member 50 drives the resilient arm 56 of the resilient member 48 by the guiding section 102 and supports the resilient arm 56 of the resilient member 48 by the protruding portion 100, such that the auxiliary portion 58 is disengaged from the predetermined feature 34 and is not blocked by the first wall section 104 and the second wall section 106 of the predetermined feature 34, thereby allowing the second rail 24 to displace away from the working position W, e.g., to the second predetermined position P2 along the first direction D1, or to the first predetermined position P1 along the second direction D2.

Figure 16:
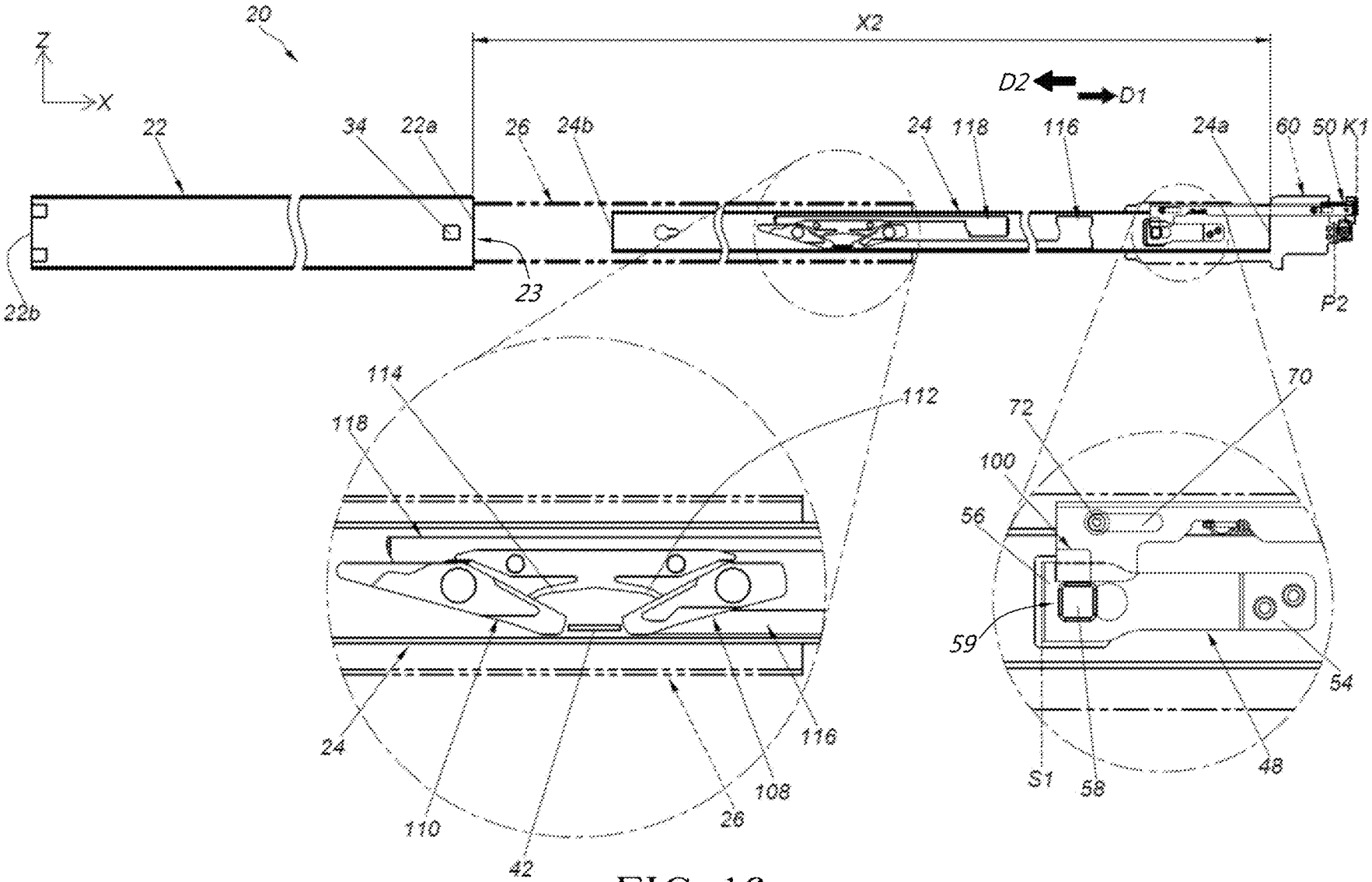
FIG. 16 is a diagram of the slide rail assembly with the first rail at a fully extended position and the operating member at the first operating position according to the first embodiment of the present invention.

As shown in FIG. 16, the slide rail assembly 20 further includes a first predetermined member 108 and a second predetermined member 110. The first predetermined member 108 and the second predetermined member 110 are movably mounted on, e.g., pivotally connected to, the second rail 24. Preferably, the slide rail assembly 20 further includes at least one resilient section. In this embodiment, by way of example, the slide rail assembly 20 includes a first resilient section 112 and a second resilient section 114, which are configured to provide resilient forces to the first predetermined member 108 and the second predetermined member 110, respectively.

It should be noticed that when it is not required to stop the second rail 24 at the working position W, the operating member 50 does not need to be operated to the second operating position K2. Furthermore, the protruding portion 100 of the operating member 50 at the first operating position K1 is configured to abut against and support the resilient arm 56 of the resilient member 48 to position the resilient member 48 in the first predetermined state S1 for preventing the auxiliary portion 58 from being blocked by the first wall section 104 of the predetermined feature 34, thereby allowing the resilient member 48 to pass over the predetermined feature 34 as the second rail 24 is displaced relative to the first rail 22 along the first direction D1. When the second rail 24 is displaced along the first direction D1 and reaches the second predetermined position P2 through the working position W, the first predetermined member 108 and the second predetermined member 110 are configured to engage with the auxiliary feature 42 of the third rail 26 for maintaining the second rail 24 at the second predetermined position P2. Besides, in order to allow the second rail 24 to displace away from the second predetermined position P2, the first predetermined member 108 and the second predetermined member 110 are configured to be operated to disengage from the auxiliary feature 42 of the third rail 26 by a first linking member 116 and a second linking member 118, respectively.

Preferably, when the second rail 24 is located at the working position W relative to the first rail 22, the first end 24*a* of the second rail 24 protrudes from the first end 22*a* of the first rail 22 by a first predetermined distance X1 (as shown in FIG. 12). When the second rail 24 is located at the second predetermined position P2 relative to the first rail 22, the first end 24*a* of the second rail 24 protrudes from the first end 22*a* of the first rail 22 by a second predetermined distance X2 (as shown in FIG. 16) greater than the first predetermined distance X1.

Figure 4:
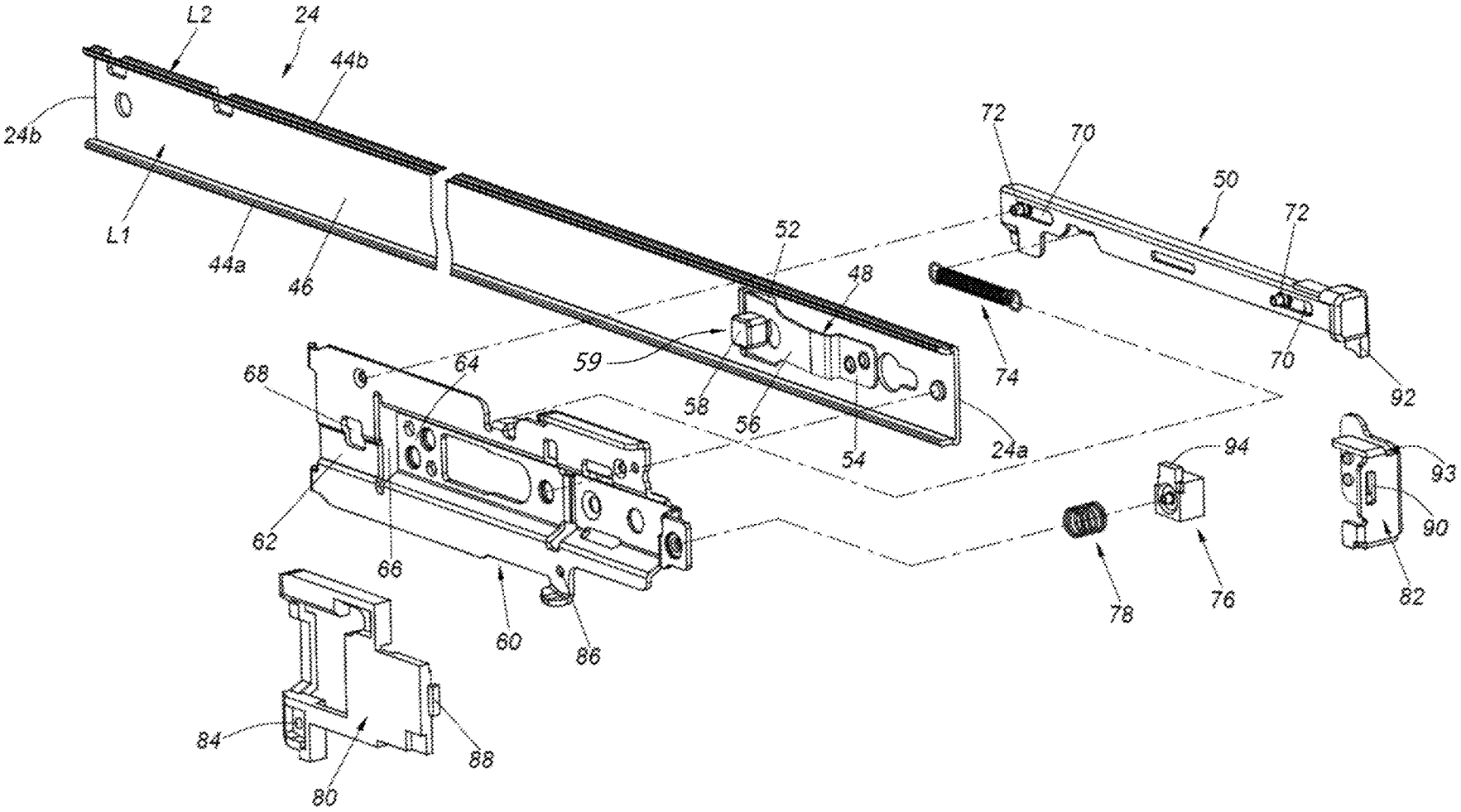
FIG. 4 is a partial exploded diagram of the slide rail assembly according to the first embodiment of the present invention.

As shown in FIG. 2, FIG. 4 and FIG. 16, when the second rail is located at the second predetermined position P2 and the operating member 50 is located at the second operating position K2, the resilient member 48 can be in the second predetermined state S2 in response to the resilient force F1. At least one of the first rail 22 and the resilient member 48 includes a guiding portion configured to abut against another one of the first rail 22 and the resilient member 48 for driving the resilient member 48 to move from the second predetermined state S2 toward the first predetermined state S1 to allow the second rail 24 to displace from the second predetermined position P2 along the second direction D2 toward the working position W. In this embodiment, by way of example, the first end 22*a* of the first rail 22 and a rear end of the auxiliary portion 58 of the resilient member 48 respectively includes a first guiding portion 23 and a second guiding portion 59 configured to abut against each other for driving the resilient member 48 to move from the second predetermined state S2 toward the first predetermined state S1 to allow the auxiliary portion 58 of the resilient member 48 to pass through the first end 22*a* of the first rail 22 along the second direction, thereby allowing the second rail 24 to displace from the second predetermined position P2 along the second direction D2 toward the working position W. When the second rail 24 is displaced from the second predetermined position P2 along the second direction D2 and reaches the working position W, the resilient member 48 returns to the second predetermined state S2, such that the auxiliary portion 58 protrudes out of the corresponding hole 68 to stretch into the predetermined feature 34 of the longitudinal wall 30 of the first rail 22, thereby stopping the second rail 24 at the working position W. Besides, in this embodiment, the second guiding portion 59 can be an inclined surface or an arc surface, and the first guiding portion 23 can be a flat surface. However, the present invention is not limited to this embodiment. For example, in another embodiment, both the first guiding portion 23 and the second guiding portion 59 can be inclined surfaces or arc surfaces. Alternatively, in another embodiment, the first guiding portion 23 can be an inclined surface or an arc surface, and the second guiding portion 59 can be a flat surface.

Figure 17:
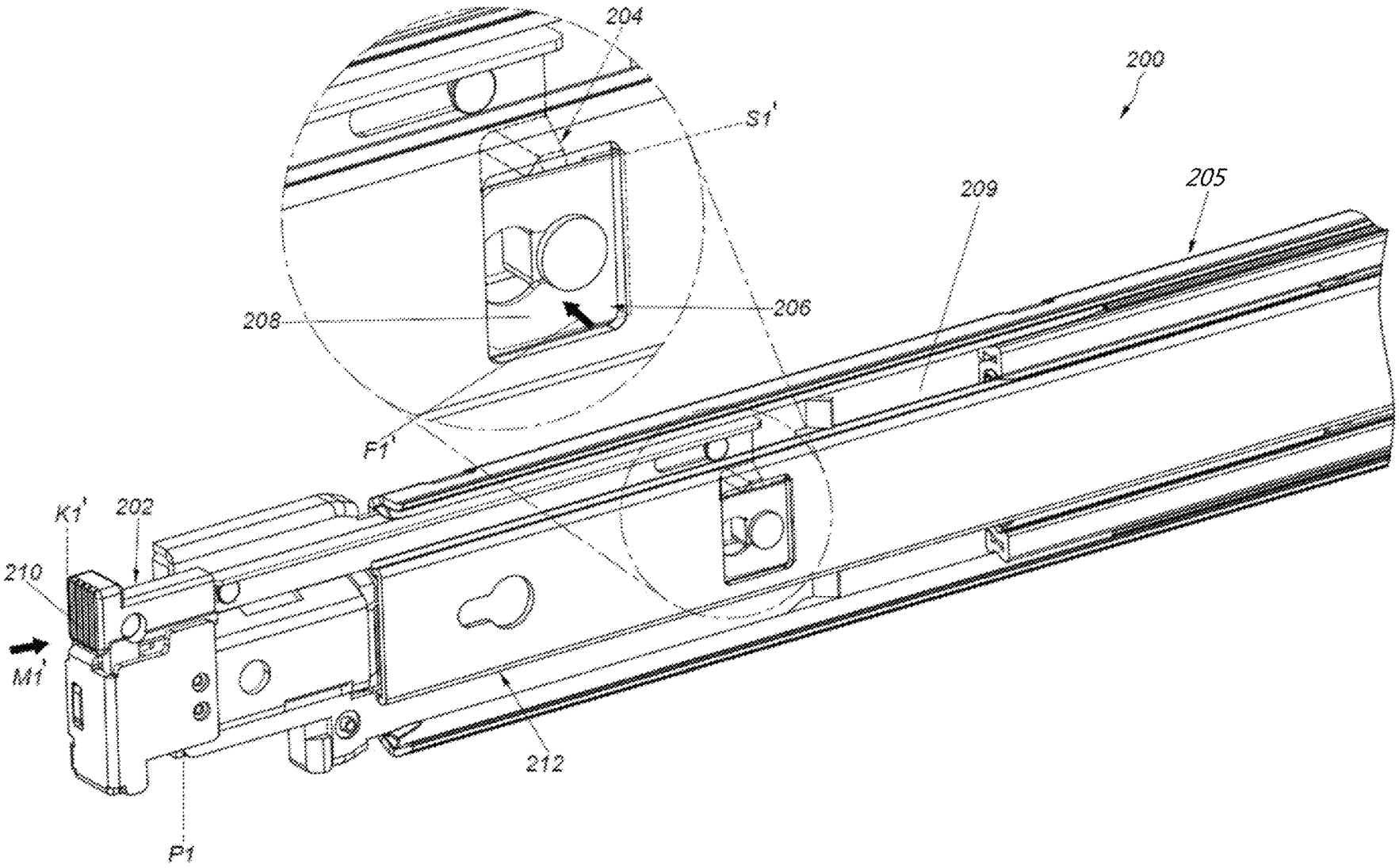
FIG. 17 is a diagram of a slide rail assembly with an operating member at a first operating position according to a second embodiment of the present invention.

As shown in FIG. 17, in a second embodiment, different from the first embodiment, a slide rail assembly 200 does not include the button member 76 and the recovering resilient member 74 of the first embodiment. Furthermore, when an operating member 202 is located at a first operating position K1', a protruding portion 204 of the operating member 202 is configured to support a resilient arm 208 of a resilient member 206 to maintain the resilient member 206 in a first predetermined state S1', such that the resilient member 206 accumulates a resilient force F1' oriented toward a longitudinal wall 209 of a first rail 205.

Figure 18:
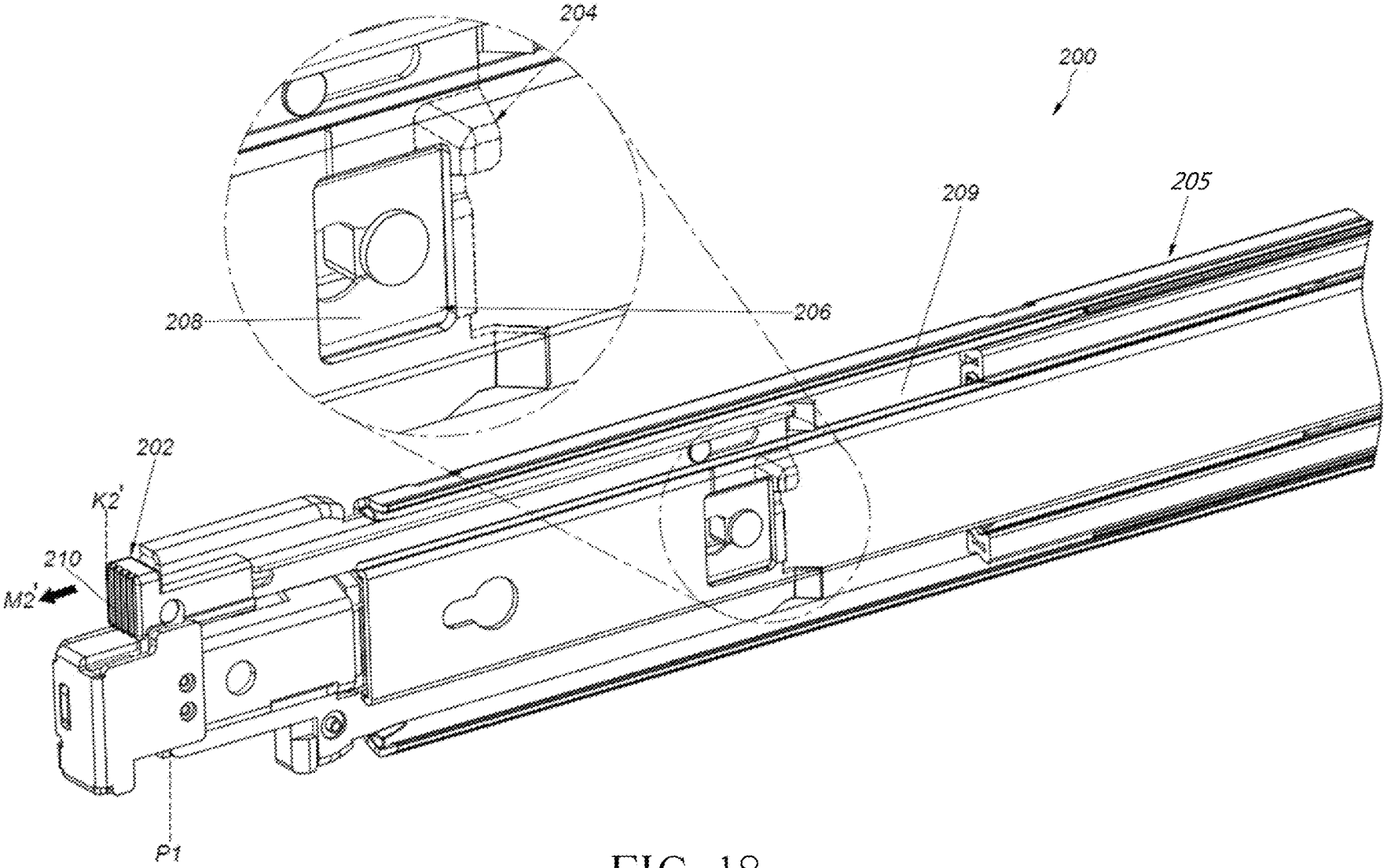
FIG. 18 is a diagram of the slide rail assembly with the operating member at a second operating position according to the second embodiment of the present invention.

As shown in FIG. 17 and FIG. 18, when an operating portion 210 of the operating member 202 is operated with a first predetermined force M1' along the first predetermined operating direction to drive the operating member 202 to move from the first operating position K1' to a second operating position K2' along the longitudinal direction, the protruding portion 204 of the operating member 202 no longer supports the resilient arm 208 of the resilient member 206, such that the resilient member 206 moves away from the first predetermined state S1' in response to the resilient force F1'. Accordingly, when a second rail 212 is displaced from the first predetermined position P1 and reaches the working position, an auxiliary portion of the resilient member 206 can be blocked by a predetermined feature of the first rail 205. The blocking relationship between the auxiliary portion of the resilient member 206 and the predetermined feature of the first rail 205 of the second embodiment is identical to the blocking relationship between the auxiliary portion 58 of the resilient member 48 and the predetermined feature 34 of the first embodiment. Detailed description is omitted herein for simplicity.

Besides, since the slide rail assembly 200 has neither a button member nor a recovering resilient member, the operating member 202 has to be manually operated with a second predetermined force M2 along a second operating direction opposite the first operating direction to return from the second operating position K2' (as shown in FIG. 18) back to the first operating position K1' (as shown in FIG. 17), thereby allowing the resilient member 206 to return to the first predetermined state S1'.

From the above, the slide rail assembly 20 or 200 of the present invention includes the following characteristics. The operating member 50 or 202 can be moved to the first operating position K1 or K1' for disenabling the blocking function that stops the second rail 24 or 212 at the working position, or to the second operating position K2 or K2' for enabling the blocking function that stops the second rail 24 or 212 at the working position according to practical demands. Therefore, the present invention offers operational flexibility, which facilitates operation or maintenance of the slide rail assembly and/or the carried object supported by the slide rail assembly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly comprising:

a first rail comprising a predetermined feature;

a second rail displaceable relative to the first rail;

a resilient member arranged on the second rail; and an operating member movable relative to the second rail between a first operating position and a second operating position;

wherein the operating member at the first operating position is configured to abut against the resilient member to prevent the resilient member from being blocked by the predetermined feature, thereby allowing the resilient member to pass over the predetermined feature as the second rail is displaced relative to the first rail along a first direction or a second direction opposite to the first direction;

wherein the operating member at the second operating position is configured not to abut against the resilient member to allow the resilient member to be blocked by the predetermined feature, thereby stopping the second rail at a working position when the second rail is displaced and reaches the working position relative to the first rail along the first direction or the second direction;

wherein the operating member is movably mounted on the second rail, the second rail is displaceable relative to the first rail from a first predetermined position to a second predetermined position along the first direction or from the second predetermined position to the first predetermined position along the second direction, and the working position is located between the first predetermined position and the second predetermined position;

wherein one of the first rail and the resilient member comprises a guiding portion configured to abut against another one of the first rail and the resilient member for driving the resilient member for allowing the second rail to displace from the second predetermined position along the second direction toward the working position.

2. A slide rail assembly comprising:

a first rail comprising a predetermined feature, the predetermined feature comprising a first wall section;

a second rail displaceable relative to the first rail longitudinally;

a resilient member arranged on the second rail, the resilient member comprising an auxiliary portion;

an operating member movable relative to the second rail between a first operating position and a second operating position;

a recovering resilient member, such that the operating member moves from the second operating position to the first operating position in response to a recovering resilient force provided by the recovering resilient member; and a button member movably mounted on the second rail;

wherein the operating member at the first operating position is configured to support the resilient member, such that the resilient member accumulates a resilient force in a predetermined state to allow the resilient member to pass over the predetermined feature as the second rail is displaced relative to the first rail away from a first predetermined position along a first direction;

wherein the operating member at the second operating position is configured not to support the resilient member, such that the resilient member moves away from the predetermined state in response to the resilient force to allow the auxiliary portion to be blocked by the first wall section of the predetermined feature to stop the second rail at a working position, thereby preventing the second rail from displacing away from the working position along the first direction when the second rail is displaced and reaches the working position relative to the first rail from the first predetermined position along the first direction;

wherein the button member is movable between a blocking state and a non-blocking state, and when the operating member is located at the second operating position, the button member in the blocking state is configured to block the operating member, such that the operating member is maintained at the second operating position to keep the recovering resilient member accumulating the recovering resilient force.

3. The slide rail assembly of claim 2, wherein the predetermined feature further comprises a second wall section opposite to the first wall section, and when the second rail is located at the working position relative to the first rail, the operating member at the second operating position is configured not to support the resilient member, such that the resilient member moves away from the predetermined state in response to the resilient force to allow the auxiliary portion to be blocked by the second wall section of the predetermined feature, thereby preventing the second rail from displacing away from the working position along a second direction opposite to the first direction.

4. The slide rail assembly of claim 3, wherein when the second rail is located at the working position relative to the first rail, the operating member at the first operating position is configured to support the resilient member, such that the resilient member accumulates the resilient force in the predetermined state to prevent the auxiliary portion from being blocked by the first wall section and the second wall section of the predetermined feature, thereby allowing the second rail to displace away from the working position.

5. The slide rail assembly of claim 2, wherein the second rail is further movable to a second predetermined position relative to the first rail, the first predetermined position is a retracted position, and the second predetermined position is a fully extended position.

6. The slide rail assembly of claim 5, wherein the working position is located between the first predetermined position and the second predetermined position.

7. The slide rail assembly of claim 6, wherein each of the first rail and the second rail comprises a first end and a second end opposite to the first end, when the second rail is located at the working position relative to the first rail, the first end of the second rail protrudes from the first end of the first rail by a first predetermined distance, and when the second rail is located at the second predetermined position relative to the first rail, the first end of the second rail protrudes from the first end of the first rail by a second predetermined distance greater than the first predetermined distance.

8. The slide rail assembly of claim 2, wherein the operating member is movably mounted on the second rail.

9. The slide rail assembly of claim 8, wherein the operating member is movable relative to the second rail along a longitudinal direction.

10. The slide rail assembly of claim 9, wherein a longitudinal hole is arranged on one of the operating member and the second rail, and another one of the operating member and the second rail passes through a portion of the longitudinal hole to restrict movement of the operating member relative to the second rail within a limited range.

11. The slide rail assembly of claim 2, wherein the operating member at the first operating position is configured to hold the button member in the non-blocking state.

12. The slide rail assembly of claim 2, further comprising an auxiliary resilient member configured to provide a resilient force to the button member.

13. The slide rail assembly of claim 2, wherein a moving direction of the operating member is parallel to a longitudinal direction, and a moving direction of the button member is parallel to a transverse direction.

14. A slide rail assembly comprising:

a first rail comprising a predetermined feature, the predetermined feature comprising a first wall section;

a second rail displaceable relative to the first rail longitudinally, the second rail comprising an extending member, the extending member comprising a first extending portion and a second extending portion, the first extending portion and the second extending portion being spaced apart from each other by a transverse distance to form a mounting space between the first extending portion and the second extending portion;

a resilient member arranged on the second rail, the resilient member comprising an auxiliary portion and a resilient arm stretching into the mounting space along a longitudinal direction, the first extending portion and the second extending portion being configured to restrict resilient movement of the resilient arm of the resilient member within a limited range; and an operating member movable relative to the second rail between a first operating position and a second operating position, the operating member comprising a protruding portion, one of the protruding portion of the operating member and the resilient member comprising a guiding section;

wherein the protruding portion of the operating member at the first operating position is configured to support the resilient member, such that the resilient member accumulates a resilient force in a predetermined state to prevent the auxiliary portion from being blocked by the first wall section of the predetermined feature as the second rail is displaced relative to the first rail from a first predetermined position to a second predetermined position along a first direction;

wherein the protruding portion of the operating member at the second operating position is configured not to support the resilient member, such that the resilient member moves from the predetermined state in response to the resilient force to allow the auxiliary portion to be blocked by the first wall section of the predetermined feature to stop the second rail at a working position, thereby preventing the second rail from displacing from the working position to the second predetermined position along the first direction when the second rail is displaced and reaches the working position relative to the first rail along the first direction;

wherein when the second rail is located at the working position relative to the first rail, the operating member moving from the second operating position to the first operating position drives the resilient member by the guiding section and supports the resilient member by the protruding portion to prevent the auxiliary portion of the resilient member from being blocked by the first wall section of the predetermined feature, thereby allowing the second rail to displace from the working position to the second predetermined position along the first direction.

15. The slide rail assembly of claim 14, wherein the predetermined feature further comprises a second wall section, and when the second rail is located at the working position relative to the first rail, the protruding portion of the operating member at the second operating position is configured not to support the resilient member, such that the resilient member moves away from the predetermined state in response to the resilient force to allow the auxiliary portion to be blocked by the second wall section of the predetermined feature, thereby preventing the second rail from displacing from the working position to the first predetermined position along a second direction opposite to the first direction.

16. The slide rail assembly of claim 15, wherein when the second rail is located at the working position relative to the first rail, the protruding portion of the operating member at the first operating position is configured to support the resilient member, such that the resilient member accumulates the resilient force in the predetermined state to prevent the auxiliary portion from being blocked by the first wall section and the second wall section of the predetermined feature, thereby allowing the second rail to displace away from the working position.

* * * * *